US011040230B2

(12) United States Patent
Johnson

(10) Patent No.: US 11,040,230 B2
(45) **Date of Patent: *Jun. 22, 2021**

(54) FIRE SPRINKLER VALVE ACTUATOR

(71) Applicant: TiNi Alloy Company, Oakland, CA (US)

(72) Inventor: Alfred David Johnson, Berkeley, CA (US)

(73) Assignee: TiNi Alloy Company, Oakland, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 16/188,270

(22) Filed: Nov. 12, 2018

(65) Prior Publication Data

US 2019/0076685 A1 Mar. 14, 2019

Related U.S. Application Data

(63) Continuation-in-part of application No. 13/601,749, filed on Aug. 31, 2012, now Pat. No. 10,124,197.

(51) Int. Cl.
*A62C 37/00* (2006.01)
*A62C 37/08* (2006.01)
(Continued)

(52) U.S. Cl.
CPC ..... *A62C 37/08* (2013.01); *A62C 31/005* (2013.01); *A62C 37/11* (2013.01)

(58) Field of Classification Search
CPC ..... A62C 37/08; A62C 37/11; A62C 31/005
See application file for complete search history.

(56) References Cited

U.S. PATENT DOCUMENTS 368,425 A 8/1887 Ross et al.
538,593 A 4/1895 Naylor, Jr.
(Continued)

FOREIGN PATENT DOCUMENTS

EP 0053596 6/1982
EP 0310439 4/1989
(Continued)

OTHER PUBLICATIONS

Antonov et al.; New advances and developments in the Stepnakov method for the growth of shaped crystals; Crystallography Reports; vol. 47; Suppl. 1; pp. S43-S52; (year of publication is sufficiently earlier than the effective U.S. filed and any foreign priority date) 2002.

(Continued)

*Primary Examiner* — Qingzhang Zhou
(74) *Attorney, Agent, or Firm* — Shay Glenn LLP

(57) ABSTRACT

Thermally activated devices, including thermally activated release devices. These devices may be used as part of any device or system in which thermal activation may be desired. In particular, described herein are thermally activated devices configured as sprinkler valves. The thermally activated devices typically include a channel and a plug element, where the plug element is a shape memory material, which may be a single-crystal shape memory alloy. The channel has two connected regions, where the first region has a diameter that is greater than the diameter of a plug element in a first configuration and the second region has a diameter that is less than the diameter of the plug element in the first configuration but greater than the diameter of the plug element in its second configuration.

17 Claims, 13 Drawing Sheets

(51) Int. Cl.
*A62C 31/00* (2006.01)
*A62C 37/11* (2006.01)

(56) References Cited

U.S. PATENT DOCUMENTS 1,560,335 A 11/1925 Czochralski
1,904,828 A 4/1933 Green
1,913,035 A 6/1933 Loepsinger
1,926,925 A 9/1933 Wescott
2,060,593 A 11/1936 Schaurte et al.
2,371,614 A 3/1945 Graves
2,586,556 A 2/1952 Mullikin
2,608,996 A 9/1952 Forman
2,610,300 A 9/1952 Walton et al.
2,647,017 A 7/1953 Coulliette
2,793,036 A 5/1957 Hansburg
2,911,504 A 11/1959 Cohn
3,229,956 A 1/1966 White
3,351,463 A 11/1967 Rozner et al.
3,357,432 A 12/1967 Sparks
3,400,906 A 9/1968 Stocklin
3,408,890 A 11/1968 Bochman, Jr.
3,435,823 A 4/1969 Edwards
3,445,086 A 5/1969 Quinn
3,454,286 A 7/1969 Anderson et al.
3,546,996 A 12/1970 Grijalva et al.
3,559,641 A 2/1971 Lay
3,561,537 A 2/1971 Dix et al.
3,613,732 A 10/1971 Willson et al.
3,620,212 A 11/1971 Fannon, Jr. et al.
3,659,625 A 5/1972 Coiner et al.
3,668,131 A 6/1972 Banush et al.
3,725,835 A 4/1973 Hopkins et al.
3,789,838 A 2/1974 Fournier et al.
3,849,756 A 11/1974 Hickling
3,888,975 A 6/1975 Ramwell
3,913,572 A 10/1975 Wheeler
3,918,443 A 11/1975 Vennard et al.
3,974,844 A 8/1976 Pimentel
3,991,898 A 11/1976 Hanson et al.
4,055,955 A 11/1977 Johnson
4,063,831 A 12/1977 Meuret
4,072,159 A 2/1978 Kurosawa
4,096,993 A 6/1978 Behr
4,145,764 A 3/1979 Kuzuki et al.
4,151,064 A 4/1979 Kuehnle
4,176,719 A 12/1979 Bray
4,177,327 A 12/1979 Mathews
4,195,773 A 4/1980 Ogden
4,243,963 A 1/1981 Jameel et al.
4,265,684 A 5/1981 Boll
4,279,190 A 7/1981 Hummel
4,340,049 A 7/1982 Munsch
4,434,855 A 3/1984 Given, Jr. et al.
4,485,545 A 12/1984 Caverly
4,501,058 A 2/1985 Schutzler
4,524,343 A 6/1985 Morgan et al.
4,549,717 A 10/1985 Dewaegheneire
4,551,974 A 11/1985 Yaeger et al.
4,553,393 A 11/1985 Ruoff
4,553,602 A 11/1985 Pieczykolan
4,558,715 A 12/1985 Walton et al.
4,567,549 A 1/1986 Lemme
4,585,209 A 4/1986 Aine et al.
4,589,179 A 5/1986 Hulting, Jr.
4,596,483 A 6/1986 Gabriel et al.
4,619,284 A 10/1986 Delarue et al.
4,654,191 A 3/1987 Krieg
4,684,913 A 8/1987 Yaeger
4,706,758 A 11/1987 Johnson
4,753,465 A 6/1988 Dalby
4,821,997 A 4/1989 Zdeblick
4,823,607 A 4/1989 Howe et al.
4,824,073 A 4/1989 Zdeblick
4,848,388 A 7/1989 Waldbusser
4,854,797 A 8/1989 Gourd
4,864,824 A 9/1989 Gabriel et al.
4,893,655 A 1/1990 Anderson
4,896,728 A 1/1990 Wolff et al.
4,919,177 A 4/1990 Homma
4,943,032 A 7/1990 Zdeblick
5,044,947 A 9/1991 Sachdeva et al.
5,060,888 A 10/1991 Vezain et al.
5,061,137 A 10/1991 Gourd
5,061,914 A 10/1991 Busch et al.
5,069,419 A 12/1991 Jerman
5,072,288 A 12/1991 MacDonald et al.
5,092,941 A 3/1992 Miura
5,102,276 A 4/1992 Gourd
5,114,504 A 5/1992 AbuJudom, II et al.
5,116,252 A 5/1992 Hartman
5,117,916 A 6/1992 Ohta et al.
5,119,555 A 6/1992 Johnson
5,129,753 A 7/1992 Wesley et al.
5,131,843 A 7/1992 Hilgers et al.
5,160,233 A 11/1992 McKinnis
5,190,546 A 3/1993 Jervis
5,192,147 A 3/1993 McCloskey
5,211,371 A 5/1993 Coffee
5,218,998 A 6/1993 Bakken et al.
5,245,738 A 9/1993 Johnson
5,309,717 A 5/1994 Minch
5,312,152 A 5/1994 Woebkenberg, Jr. et al.
5,312,247 A 5/1994 Sachdeva et al.
5,325,880 A 7/1994 Johnson et al.
5,344,117 A 9/1994 Trah et al.
5,364,046 A 11/1994 Dobbs et al.
5,395,238 A 3/1995 Andreiko et al.
5,447,432 A 9/1995 Andreiko et al.
5,456,600 A 10/1995 Andreiko et al.
5,474,448 A 12/1995 Andreiko et al.
5,474,563 A 12/1995 Myler et al.
5,494,113 A 2/1996 Polan
5,502,982 A 4/1996 Venetucci
5,543,349 A 8/1996 Kurtz et al.
5,605,543 A 2/1997 Swanson
5,619,177 A 4/1997 Johnson et al.
5,622,225 A 4/1997 Sundholm
5,640,217 A 6/1997 Hautcoeur et al.
5,641,364 A 6/1997 Golberg et al.
5,645,423 A 7/1997 Collins, Jr.
5,658,515 A 8/1997 Lee et al.
5,676,356 A 10/1997 Ekonen et al.
5,683,245 A 11/1997 Sachdeva et al.
5,695,504 A 12/1997 Gifford, III et al.
5,714,690 A 2/1998 Burns et al.
5,722,989 A 3/1998 Fitch et al.
5,771,742 A 6/1998 Bokaie et al.
5,772,378 A 6/1998 Keto-Tokoi
5,772,864 A 6/1998 Moller et al.
5,796,152 A 8/1998 Carr et al.
5,819,749 A 10/1998 Lee et al.
5,825,275 A 10/1998 Wuttig et al.
5,837,394 A 11/1998 Schumm, Jr.
5,840,199 A 11/1998 Warren
5,850,837 A 12/1998 Shiroyama et al.
5,867,302 A 2/1999 Fleming
5,903,099 A 5/1999 Johnson et al.
5,916,178 A 6/1999 Noone et al.
5,924,492 A 7/1999 Kikuchi et al.
5,930,651 A 7/1999 Terasawa
5,960,812 A 10/1999 Johnson
6,013,854 A 1/2000 Moriuchi
6,042,374 A 3/2000 Farzin-Nia et al.
6,042,553 A 3/2000 Solar et al.
6,072,617 A 6/2000 Henck
6,073,700 A 6/2000 Tsuji et al.
6,075,239 A 6/2000 Aksyuk et al.
6,080,160 A 6/2000 Chen
6,084,849 A 7/2000 Durig et al.
6,096,175 A 8/2000 Roth
6,101,164 A 8/2000 Kado et al.
6,107,004 A 8/2000 Donadio, III
6,110,204 A 8/2000 Lazarov et al.

(56) References Cited

U.S. PATENT DOCUMENTS

| | | | | |
|---|---|---|---|---|
| 6,123,153 | A | 9/2000 | Finnegan | |
| 6,124,523 | A | 9/2000 | Banas et al. | |
| 6,126,371 | A | 10/2000 | McCloskey | |
| 6,129,153 | A | 10/2000 | Joung | |
| 6,139,143 | A | 10/2000 | Brune et al. | |
| 6,169,269 | B1 | 1/2001 | Maynard | |
| 6,195,478 | B1 | 2/2001 | Fouquet | |
| 6,203,715 | B1 | 3/2001 | Kim et al. | |
| 6,224,626 | B1 | 5/2001 | Steinke | |
| 6,229,640 | B1 | 5/2001 | Zhang | |
| 6,247,493 | B1 | 6/2001 | Henderson | |
| 6,277,133 | B1 | 8/2001 | Kanesaka | |
| 6,284,067 | B1 | 9/2001 | Schwartz et al. | |
| 6,352,494 | B2 | 3/2002 | McAlonan | |
| 6,358,380 | B1 | 3/2002 | Mann et al. | |
| 6,379,383 | B1 | 4/2002 | Palmaz et al. | |
| 6,386,507 | B2 | 5/2002 | Dhuler et al. | |
| 6,406,605 | B1 | 6/2002 | Moles | |
| 6,407,478 | B1 | 6/2002 | Wood et al. | |
| 6,410,360 | B1 | 6/2002 | Steenberge | |
| 6,447,478 | B1 | 9/2002 | Maynard | |
| 6,451,668 | B1 | 9/2002 | Neumeier et al. | |
| 6,454,913 | B1 | 9/2002 | Rasmussen et al. | |
| 6,470,108 | B1 | 10/2002 | Johnson | |
| 6,475,261 | B1 | 11/2002 | Matsumoto et al. | |
| 6,524,322 | B1 | 2/2003 | Berreklouw | |
| 6,533,905 | B2 | 3/2003 | Johnson et al. | |
| 6,537,310 | B1 | 3/2003 | Palmaz et al. | |
| 6,554,077 | B2 * | 4/2003 | Polan | A62C 37/14 169/19 |
| 6,582,985 | B2 | 6/2003 | Cabuz et al. | |
| 6,592,724 | B1 | 7/2003 | Rasmussen et al. | |
| 6,596,102 | B2 | 7/2003 | Homma | |
| 6,605,111 | B2 | 8/2003 | Bose et al. | |
| 6,614,570 | B2 | 9/2003 | Johnson et al. | |
| 6,620,634 | B2 | 9/2003 | Johnson et al. | |
| 6,624,730 | B2 | 9/2003 | Johnson et al. | |
| 6,669,794 | B1 | 12/2003 | Bellouard et al. | |
| 6,669,795 | B2 | 12/2003 | Johnson et al. | |
| 6,672,502 | B1 | 1/2004 | Paul et al. | |
| 6,688,828 | B1 | 2/2004 | Post | |
| 6,729,599 | B2 | 5/2004 | Johnson | |
| 6,742,761 | B2 | 6/2004 | Johnson et al. | |
| 6,746,890 | B2 | 6/2004 | Gupta et al. | |
| 6,771,445 | B1 | 8/2004 | Hamann et al. | |
| 6,790,298 | B2 | 9/2004 | Johnson et al. | |
| 6,805,898 | B1 | 10/2004 | Wu et al. | |
| 6,811,910 | B2 | 11/2004 | Tsai et al. | |
| 6,840,329 | B2 | 1/2005 | Kikuchi et al. | |
| 6,843,465 | B1 | 1/2005 | Scott | |
| 6,849,085 | B2 | 2/2005 | Marton | |
| 6,852,132 | B1 | 2/2005 | Houser et al. | |
| 6,854,668 | B2 | 2/2005 | Wancho et al. | |
| 6,908,275 | B2 | 6/2005 | Nelson et al. | |
| 6,918,545 | B2 | 7/2005 | Franson et al. | |
| 6,920,966 | B2 | 7/2005 | Buchele et al. | |
| 6,955,187 | B1 | 10/2005 | Johnson | |
| 7,022,173 | B2 | 4/2006 | Cummings et al. | |
| 7,040,323 | B1 | 5/2006 | Menchaca et al. | |
| 7,044,596 | B2 | 5/2006 | Park | |
| 7,073,504 | B2 | 7/2006 | Callister et al. | |
| 7,084,726 | B2 | 8/2006 | Gupta et al. | |
| 7,201,367 | B2 | 4/2007 | Wietharn | |
| 7,422,403 | B1 | 9/2008 | Johnson et al. | |
| 7,441,888 | B1 | 10/2008 | Johnson | |
| 7,524,914 | B2 | 4/2009 | Mather et al. | |
| 7,540,899 | B1 | 6/2009 | Johnson | |
| 7,544,257 | B2 | 6/2009 | Johnson et al. | |
| 7,586,828 | B1 | 9/2009 | Xiaogdang | |
| 7,632,361 | B2 | 12/2009 | Johnson et al. | |
| 7,736,687 | B2 | 6/2010 | Sims et al. | |
| 7,763,342 | B2 | 7/2010 | Johnson | |
| 7,793,911 | B2 | 9/2010 | Fontana et al. | |
| 7,842,143 | B2 | 11/2010 | Johnson et al. | |
| 7,981,258 | B2 | 7/2011 | Johnson et al. | |
| 8,007,674 | B2 | 8/2011 | Johnson | |
| 8,349,099 | B1 | 1/2013 | Johnson et al. | |
| 8,382,917 | B2 | 2/2013 | Johnson | |
| 8,584,767 | B2 | 11/2013 | Johnson et al. | |
| 8,684,101 | B2 | 4/2014 | Johnson et al. | |
| 10,124,197 | B2 | 11/2018 | Johnson | |
| 2001/0023010 | A1 | 9/2001 | Yamada et al. | |
| 2002/0018325 | A1 | 2/2002 | Nakatani et al. | |
| 2002/0062154 | A1 | 5/2002 | Ayers | |
| 2002/0106614 | A1 | 8/2002 | Prince et al. | |
| 2002/0192617 | A1 | 12/2002 | Phan et al. | |
| 2003/0002994 | A1 | 1/2003 | Johnson et al. | |
| 2003/0078465 | A1 | 4/2003 | Pai et al. | |
| 2003/0170130 | A1 | 9/2003 | Johnson | |
| 2004/0083006 | A1 | 4/2004 | Ellingsen | |
| 2004/0200551 | A1 | 10/2004 | Brhel et al. | |
| 2004/0221614 | A1 | 11/2004 | Holemans et al. | |
| 2004/0243219 | A1 | 12/2004 | Fischer et al. | |
| 2004/0249399 | A1 | 12/2004 | Cinquin et al. | |
| 2005/0113933 | A1 | 5/2005 | Carter et al. | |
| 2005/0252665 | A1 * | 11/2005 | Kammer | A62C 37/12 169/42 |
| 2006/0118210 | A1 | 6/2006 | Johnson | |
| 2006/0204738 | A1 | 9/2006 | Dubrow et al. | |
| 2006/0213522 | A1 | 9/2006 | Menchaca et al. | |
| 2006/0240953 | A1 | 10/2006 | Shahinpoor | |
| 2007/0173787 | A1 | 7/2007 | Huang et al. | |
| 2007/0207321 | A1 | 9/2007 | Abe et al. | |
| 2007/0246233 | A1 | 10/2007 | Johnson | |
| 2008/0075557 | A1 | 3/2008 | Johnson et al. | |
| 2008/0213062 | A1 | 9/2008 | Johnson et al. | |
| 2009/0061378 | A1 | 3/2009 | Kim et al. | |
| 2009/0187243 | A1 | 7/2009 | Johnson | |
| 2010/0006304 | A1 * | 1/2010 | Johnson | A62C 37/16 169/19 |
| 2010/0129766 | A1 | 5/2010 | Hilgers | |
| 2010/0190127 | A1 | 7/2010 | Ghantiwala et al. | |
| 2011/0253525 | A1 | 10/2011 | Johnson et al. | |
| 2011/0299915 | A1 | 12/2011 | Crane et al. | |
| 2011/0313513 | A1 | 12/2011 | Johnson | |
| 2012/0048432 | A1 | 3/2012 | Johnson et al. | |
| 2015/0266141 | A1 | 9/2015 | Johnson et al. | |

FOREIGN PATENT DOCUMENTS

| | | | |
|---|---|---|---|
| EP | 0836839 | A2 | 4/1998 |
| EP | 1122526 | | 8/2001 |
| EP | 1238600 | | 9/2002 |
| EP | 1779817 | A1 | 5/2007 |
| GB | 2187951 | | 9/1987 |
| JP | 48071713 | A | 9/1973 |
| JP | 57161031 | | 10/1982 |
| JP | 58088200 | A | 5/1983 |
| JP | 59179771 | A | 10/1984 |
| JP | 07090624 | | 4/1995 |
| JP | 10173306 | | 6/1998 |
| JP | 2000185999 | A | 7/2000 |
| SU | 1434314 | A | 10/1988 |
| WO | WO98/42277 | A1 | 10/1998 |
| WO | WO98/53362 | A2 | 11/1998 |
| WO | WO99/16387 | A1 | 4/1999 |
| WO | WO99/62432 | A1 | 12/1999 |
| WO | WO00/04204 | A1 | 1/2000 |
| WO | WO03/52150 | A2 | 6/2003 |
| WO | WO2005/108635 | A2 | 11/2005 |
| WO | WO2006/019943 | A1 | 2/2006 |
| WO | WO2009/114186 | A2 | 9/2009 |
| WO | WO2009114186 | * | 9/2009 |

OTHER PUBLICATIONS

Autodesk; Algor Inc.; Simulating Rubber and Foam Materials; Machine Design; Nov. 17, 2005; accessed from http://www.algor.com/news_pub/tech_reports/2005/rubber&foam/default.asp.

Bosch et al., "A silicon microvalve with combined electromagnetic/ electrostatic actuation," Sensors and Actuators A, pp. 37-38; pp. 684-692, Jun.-Aug. 1993.

(56) References Cited

OTHER PUBLICATIONS

Brice et al.; Crystal Growth; Ullmann's Encyclopedia of Industrial Chemistry; Wiley-VCH Verlag GmBH; pp. 1, 29-42, 50; (year of publication is sufficiently earlier than the effective U.S. filed and any foreign priority date) 2007.
Buchaillot et al.; Thin film of titanium/nickel shape memory alloy for multi-degree of freedom microactuators; Seisan Kenkyu, vol. 51, No. 8, pp. 22-23; (year of publication is sufficiently earlier than the effective U.S. filed and any foreign priority date) 1999.
Christian et al.; The application of shape memory actuators in anthropomorphic upper limb prostheses; Artif. Organs; vol. 27; No. 5; pp. 473-477; May 1, 2003.
Creuziger et al.; Initial transformation around a notch tip in CuA1Ni: experiment and modeling; Acta Materialia; vol. 56; Issue 3; pp. 518-526; Feb. 2008.
Dario et al.; Shape memory alloy microactuators for minimal invasive surgery; Proceedings of SMST-94 Conference; pp. 427-433; Pacific Grove CA; Mar. 7-10, 1994.
ElastametTM brochure from New Discovery Metals; (year of publication is sufficiently earlier than the effective U.S. filed and any foreign priority date) 2007; 1 page.
ElastametTM website screen capture, accessed Jul. 23, 2008.
Fu et al.; The growth characteristics with a shape memory effect; J. Phys.: Condens. Matter; vol. 4; No. 43; pp. 8303-8310; Oct. 26, 1992.
Gill et al.; Three-Dimensional Thin-Film Shape Memory Alloy Microactuator With Two-Way Effect; Journal of Microelectromechanical Sys.; vol. 11; No. 1; pp. 68-77; Feb. 2002.
Johnson et al., "Application of shape memory alloys: advantages, disadvantages, and limitations," Micromachining and Microfabrication Process Technology VII, 22-4, San Francisco, CA, USA, vol. 4557, pp. 341-351, Oct. 2001.
Johnson, A. D.; Vacuum-deposited TiNi shape memory film: Characterization and applications in microdevices; J. Micromech. Microeng.; vol. 1; No. 1; pp. 34-41; Mar. 1991.
Krulevitch et al.; Thin film shape memory alloy microactuators; J. Micromech. Microeng.; vol. 5; issue 4; 26 pgs.; Dec. 1996.
Martynov, V., "TiNi thin films for microactuators and microdevices: sputter deposition and processing techniques", Thermec' 2003, Internat'l Conf. on Processing and Manufacturing of Advanced Materials, Jul. 7-11, 2003, Leganes, Madrid, Spain, Materials Science Forum, vol. 426-432; pp. 3475-3480, Jul. 7, 2003.
Morgan; Medical shape memory alloy applications—the market and its products; Materials Science and Engineering: A; 378(1-2); pp. 16-23; Jul. 25, 2004.
Pauling, Linus, College Chemistry, second edition, W.H. Freeman and Company, San Francisco, pp. 81-91; (year of publication is sufficiently earlier than the effective U.S. filed and any foreign priority date) 1955.
Perez et al.; Single Motion Shape Memory Coupling; Proceedings of the 41st Aerospace Mechanisms Symposium (NASA/CP-2012-217653); Pasadena, CA; 5 pgs.; May 16-18, 2012.
Qingfu et al.; Stabilisation of martensite during training of Cu—Al—Ni single crystals; Journal de Physique IV; Collloqu C2; Supplement to the Journa de Physique III; vol. 5; pp. 181-186; Feb. 1995.
Recarte et al.; Influence of Al and Ni concentration on the martensitic transformation in Cu—Al—Ni shape-memory alloys; Metallurgical and MaterialsTransactions A; vol. 33A; pp. 2581-2591; Aug. 2002.
Schetky, L.M.; Shape-memory alloys; Scientific American; vol. 241; pp. 74-82; Nov. 1979.
Sittner et al.; Stress induced martensitic transformations in tension/torsion of CuAlNi single crystal tube; Scripta Materialia; vol. 48; No. 8; pp. 1153-1159; Apr. 14, 2003.
Sutuo et al.; Development of medical guide wire of Cu—Al—Mn-base superelastic alloy with functionally graded characteristics; Mater Res Part B: Appl Biomater; vol. 69B; Issue 1; pp. 64-69; Apr. 15, 2004.
Takabayashi et al.; Reversible shape memory alloy film fabricated by RF sputtering; Materials and Manufacturing Processes, vol. 13, No. 2, pp. 275-286, 1998.
Viahhi et al.; Robototechnic Constructions Based on Cu—Al—Ni Single Crystal Actuators; Proceedings of Second International Conference on Shape Memory and Superelastic Technologies; Pacific Grove; CA, USA; 6 pgs; Mar. 2-6, 1997.
Wang et al.; Temperature memory effect in CuAlNi single crystalline and CUZnAl polycrystalline shape memory alloys; Thermochimica Acta; vol. 448; Issue 1; pp. 69-72; Sep. 1, 2006.
Yahia et al.; Bioperformance of shape memory alloy single crystals; Bio-Medical Materials and Engineering; vol. 16; No. 2; pp. 101-118, 2006.
Zhang et al.; Nanoscale pseudoelasticity of single-crystal Cu—Al—Ni shape-memory alloy induced by cyclic nanoindentation; J Mater Sci; vol. 41; issue 15; pp. 5021-5024; Aug. 2006.
Zhang et al.; The variant selection criteria in single-crystal CuAlNi shape memory alloys; Smart Mater. Struct.; vol. 9; No. 5; pp. 571-581; Oct. 2000.
Zhdanov et al.; Thermal stresses in tubes, produced from a melt by the Stepanov method, during their cooling; Journal of Engineering Physics and Thermophysics; vol. 68; No. 1; pp. 80-89; Jan.-Feb. 1995.
Johnson; U.S. Appl. No. 11/006,501 entitled "Anastomosis device and method," filed Dec. 6, 2004.

* cited by examiner

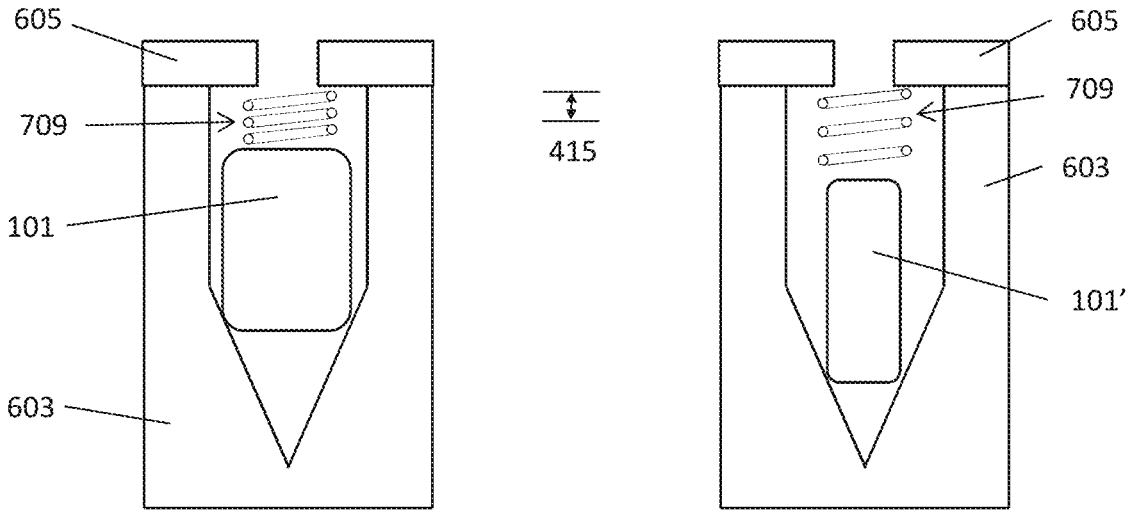
FIG. 7A
FIG. 7B
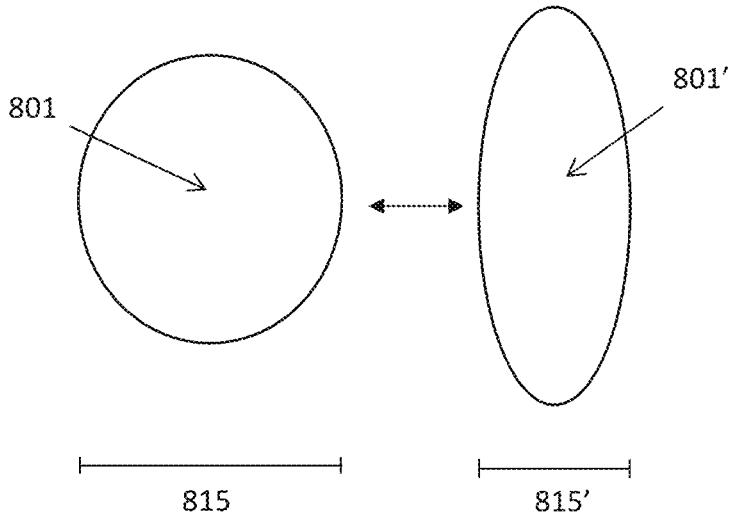
FIG. 8

FIRE SPRINKLER VALVE ACTUATOR

CROSS REFERENCE TO RELATED APPLICATIONS

This patent application claims priority as a continuation-in-part to U.S. patent application Ser. No. 13/601,749, titled "FIRE SPRINKLER VALVE ACTUATOR," filed Aug. 31, 2012, now U.S. Pat. No. 10,124,197 and herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Described herein are valves, including fire safety devices and especially thermally actuated sprinklers commonly used in commercial and residential buildings.

BACKGROUND

Large numbers of thermally-actuated sprinklers are installed in structures, both old and new every year. These sprinklers, generally installed in the ceiling, are connected to a water supply, and are intended to release the water into the room when the temperature in the room indicates that a fire/conflagration is taking place.

Numerous methods have been used in the past to trigger release of the sprinkler head. For example, low-melting alloys such as solders are used to bond two components together. When heated above the melting temperature of the eutectic alloy, the bond between the two components is released and a control valve is allowed to spring open. This type of actuator is subject to failure as the solder ages and crystallizes, thus weakening the bond.

In some sprinkler valves, a glass tube is nearly filled with a low-temperature boiling liquid and sealed. As the temperature increases the pressure inside the tube becomes great enough to rupture the tube and it fractures, permitting a spring-loaded valve to open. Premature failure may occur if the sprinkler head is subjected to mechanical shock and the glass tube is cracked. False triggering of sprinkler heads sometimes causes damage that is very expensive to repair, and contributes to the cost of fire insurance.

Thermally-actuated fire safety devices must meet a strict set of codes to be acceptable. Actuation temperature varies, typically between 135 to 170° F. (57-77° C.), depending on the requirements of the installation. One example is a Victaulic Guardian sprinkler head specified as 175° C.

Fire safety sprinklers are continually improved as technology becomes more sophisticated. The current invention introduces the use of a shape memory alloy actuator combined with a novel release mechanism to create a product that will meet current and future needs of fire safety sprinkler heads.

Although shape memory alloys have been proposed for valves, including sprinkler valves, such early proposed devices suffer from many of the defects mentioned above, including failure, based on the structure and the manner in which the shape memory alloy is employed. For example, US 2011/0299915 to Crane et al. describes a shape memory alloy (SMA valve. This valve uses a circular SMA component that is expanded, and force-fit to produce friction-based interference hold that can be released by an increase in temperature. The SMA component is Nitinol (polycrystalline nickel titanium).

To date, Nitinol devices for use in valves such as sprinklers have been difficult to construct and commercialize, at least in part because shape memory alloys such as Nitinol do not have a flat stress plateau, and have proven difficult to build with a reliable and accurate activation temperature range. To meet governmental safety standards for sprinklers, the actuation temperature must be within a narrow margin (e.g., of +/−5° C. or less) for an activation temperature. Such a narrow margin is difficult to achieve with most shape memory alloys, including nickel titanium, because of the relationship between stress, strain, and temperature. For example, the sloped stress plateau introduces uncertainty in the transition temperature depending on the stress and strain of the shape memory alloy actuator. In addition, the transition temperature of many shape memory alloys (including Nitinol) is relatively low (e.g., below 100° C.), limiting its use as a fire sprinkler valve.

Described herein are valves, including sprinkler valves, that may address many of the shortcomings of the prior art identified above. For example, the use of a shape memory alloy actuator combined with a novel release mechanism as described herein provides a robust and reliable valve that will meet current and future needs of fire safety sprinkler heads.

SUMMARY OF THE DISCLOSURE

Broadly and generally, the devices and methods described herein include thermally activated devices, including thermally activated release devices. These devices may be used as part of any device or system in which thermal activation may be desired. Although many of the examples and embodiments described herein relate specifically to valves, and in particular to sprinkler valves, it is to be understood that these inventions are not limited to valves. Other systems that may include the thermally activated release devices described herein may include thermally activated switches, triggers, controls, catches, locks, and the like, including non-explosive release devices.

In general, the thermally activated release devices described herein are configured to include a channel having two (or more) diameters and a plug element within the channel that can transition between the different diameter regions as the temperature changes. The plug element is typically a shape memory alloy material. In some variations it may be beneficial for the plug to be made of a hyperelastic shape memory alloy material. The plug element (which may be referred to as a plug, a stopper, or the like) may have a first diameter in the martensitic phase and a second diameter in the austenitic diameter, where these diameters are matched to the inner diameters of the channel so that either the first or second diameter is larger than the narrower diameter of the channel and the other diameter is the same size or smaller than the narrower diameter of the channel. The transition temperature of the plug element (e.g., a hyperelastic SMA material) may be chosen or controlled so that the device is actuated at a target temperature.

For example, described herein are thermally activated release devices, the device comprising: a channel having a first region of diameter $D_1$ in fluid communication with a second region of diameter $D_2$, wherein $D_2$ is less than $D_1$; and a plug of shape memory alloy within the channel, wherein the plug comprises a martensitic phase shape having a diameter that is between $D_1$ and $D_2$ and an austenitic phase shape having a diameter that is less than or equal to $D_2$; wherein the device is configured so that a temperature change causes the plug to change from the martensitic phase shape to the austenitic phase shape so that the plug may move from the first region to the second region within the channel.

The device may also include a housing through which the channel passes. For example, the housing may have one or more opening exposing the channel (e.g., an upper or top and a lower or bottom opening). For example, the housing may comprise a hollow cylinder. The housing may be any appropriate shape, in addition to cylindrical. The channel may be open at a top and a bottom.

In some variations, the transition between the two (or more) regions of different diameters within the channel may be smooth or abrupt. For example, the channel may include a shoulder region between the first region and the second region. In some variations the transition is gradual, in other variations the transition may be abrupt.

The device may also be configured as part of a valve. In some variations, the device includes a valve poppet mechanically coupled to the plug, wherein the valve poppet is configured to release when the plug changes to the austenitic phase. The device may also include a pin connected to the plug that is configured to be displaced when the plug moves from the first region to the second region.

The thermally activated release device may also be configured as part of a fire sprinkler valve also comprising a valve body configured to connect to a pressurized fluid source that is restrained when the plug is in the martensitic phase shape and released when the plug is in the austenitic phase shape.

In general, the device may be arranged so that gravity or fluid pressure (e.g., water pressure) drives the plug towards the narrower diameter region. In some variations, the device may include a bias urging the plug towards the second region; thus the bias may allow the device to work even against gravity so that the plug may move into the narrower diameter region after it transitions to a narrower (e.g., austenitic) phase shape.

The plug may be any appropriate shape. For example, the plug may be cylindrical, ovoid, round, or the like.

As mentioned the plug may comprise a hyperelastic material. For example, the plug may comprise a CuAlNi alloy, including a single crystal CuAlNi alloy.

In general, depending on the application, the plug element may be configured to transform from narrower diameter austenitic shape to a wider-diameter martensitic shape, or from a narrower diameter martensitic shape to a wider-diameter austenitic shape.

For example, described herein are thermally activated release devices including: a channel having a first region of diameter $D_1$ in fluid communication with a second region of diameter $D_2$, wherein $D_2$ is less than $D_1$; and a plug of shape memory alloy within the channel, wherein the plug comprises an austenitic phase shape having a diameter that is less than or equal to $D_2$ and a martensitic phase shape having a diameter that is between $D_1$ and $D_2$; wherein the device is configured so that a temperature change causes the plug to change from the martensitic phase shape to the austenitic phase shape so that the plug may move from the first region to the second region within the channel. As mentioned above, in any of these variations, the plug may be a single-crystal shape memory alloy (e.g., a hyperelastic alloy), such as CuAlNi, CuAlMg, or CuAlBe. In some variations, particularly because the plug is held under stress, polycrystalline shape-memory alloy materials may be used, such as CuAlNi, or NiTi, particularly for lower-temperature activation devices (e.g., approximately <100° C.).

In some embodiments, described herein are thermally actuated fire sprinkler valve assemblies, which may include: a fluid passageway configured to connect to a source of pressurized fluid; a valve coupled to the fluid passageway; and a valve actuator assembly configured to actuate the valve to release fluid from the fluid passageway when the temperature exceeds a predetermined transition temperature, the valve actuator comprising: a channel having a first region of diameter $D_1$ in fluid communication with a second region of diameter $D_2$, wherein $D_2$ is less than $D_1$; and a plug of shape memory alloy within the channel, wherein the plug comprises a martensitic phase shape having a diameter that is between $D_1$ and $D_2$ and an austenitic phase shape having a diameter that is less than or equal to $D_2$; wherein the device is configured so that when the temperature exceeds the transition temperature, the plug changes from the martensitic phase shape to the austenitic phase shape so that the plug moves from the first region to the second region within the channel and allows the valve to open.

The assembly may also include a housing through which the channel passes. In some variations, the channel is open at a top and a bottom.

In any of the variations described herein, the plug may be configured to pass completely out of the channel after transitioning to the narrower diameter configuration, or it may be retained within the channel after transitioning to the narrower diameter configuration.

In some variations, the valve is mechanically coupled to the plug, wherein the valve is configured to open the fluid passageway when the plug changes to the austenitic phase. The device may also include a poppet and/or a pin connecting the valve to the plug that is configured to be displaced when the plug moves from the first region to the second region.

As mentioned above, the valve may also include a bias urging the plug towards the second region.

Methods of actuating a valve are also described. For example, described herein are methods of actuating a valve including the steps of: changing the diameter of a plug located within a channel from a martensitic phase shape having a first diameter to an austenitic phase shape having a second diameter, when the temperature of the plug exceeds a transition temperature; moving the plug from a first region of the channel to a second region of the channel when the plug changes from the first diameter to the second diameter, wherein the plug cannot access the second region of the channel until the diameter of the plug changes to the second diameter; and wherein movement of the plug from the first region to the second region of the channel actuates the valve.

Also described herein are methods of actuating a fire sprinkler having a valve actuated by an actuator that includes the steps of: blocking the flow of pressurized fluid from a fluid source using the valve of the fire sprinkler; changing the diameter of a plug located within a channel of the fire sprinkler from a martensitic phase shape having a first diameter to an austenitic phase shape having a second diameter, when the temperature of the plug exceeds a transition temperature; moving the plug from a first region of the channel to a second region of the channel when the plug changes from the first diameter to the second diameter, wherein the plug cannot access the second region of the channel until the diameter of the plug changes to the second diameter, wherein movement of the plug from the first region to the second region of the channel actuates the valve; and releasing pressurized fluid through the fire sprinkler.

The step of changing the diameter of the plug may include changing from a first diameter that is greater than the second diameter. Changing the diameter of the plug may comprise changing the diameter of the plug from the first to the second diameter when the temperature of the plug exceeds a transition temperature between about 79 and about 107° C. In some variations the step of changing the diameter of the plug may comprise changing the plug to the second diameter when the temperature of the plug exceed a transition temperature of between about 57 to about 77° C., 121 to about 149° C., 163 to about 191° C., 204 to about 246° C., 260 to about 302° C., or more than about 343° C.

The step of moving the plug may comprise moving the plug from a first region having a diameter that is greater than either the first diameter or the second diameter of the plug to a region having a diameter that is greater than the second diameter of the plug but not greater than the first diameter of the plug. Moving the plug from the first region of the channel to the second region of the channel when the plug changes from the first diameter to the second diameter may include moving the plug past the second region of the channel and out of the channel.

The step of releasing pressurized fluid through the fire sprinkler may include moving a pin connected to the valve and the plug.

As mentioned above, the plug may be any appropriate material, and particularly hyperelastic materials such as single-crystal shape memory alloys (SMAs). Thus, the step of changing the diameter of the plug may comprise changing the diameter of a CuAlNi plug. Changing the diameter of the plug may include changing the diameter of a single crystal shape memory alloy plug.

For example, described herein are thermally activated release devices that include an actuator comprising: a tube having a first region of inner diameter $D_1$ in fluid communication with a second region of inner diameter $D_2$, wherein $D_2$ is less than $D_1$; and a plug of shape memory alloy within the tube, wherein the plug comprises a martensitic phase shape having an outer diameter that is between $D_1$ and $D_2$ and an austenitic phase shape having an outer diameter that is less than or equal to $D_2$; wherein the actuator is configured so that a temperature change causes the plug to change from the martensitic phase shape to the austenitic phase shape so that the plug moves from the first region to the second region within the tube; and a valve coupled to the actuator, wherein the valve opens when the plug moves from the first region to the second region within the tube The first region may include an expanded region of the tube, e.g., a region of the tube that is deformed or otherwise expanded outwards. This first region of the tube may be formed by compressing and therefore expanding the shape memory alloy within the tube. In some variations a circumferential side wall of the plug fits snugly against an inner wall of the first region.

The tube may be open (e.g., open at a top and/or a bottom of the tube), or closed.

In some variations, the tube may be a first tube that is elastically deformable, so that when the plug of shape memory alloy within the first tube changes to the austenitic phase shape the inner diameter of the first region contracts (e.g., to a diameter of between $D_1$ and $D_2$). Any of these devices may include an outer tube circumferentially fitting over at least the first region of the first tube, wherein the outer tube is locked against the first tube when the plug of shape memory alloy within the first tube is in the martensitic phase shape. For example, the outer tube may be configured to move telescopically over the first tube after the plug of shape memory alloy within the first tube changes to the austenitic phase shape.

Any of these devices may include a valve poppet mechanically coupled to the actuator (e.g., to the plug, to the outer tube, etc.), wherein the valve poppet is configured to release when the plug changes to the austenitic phase. Alternatively or additionally, any of these devices may include a pin connected to the plug and configured to be displaced when the plug moves from the first region to the second region.

The thermally activated release device may be configured as part of a fire sprinkler valve also comprising a valve body configured to connect to a pressurized fluid source that is restrained when the plug is in the martensitic phase shape and released when the plug is in the austenitic phase shape.

Any of these devices may include a bias urging the plug towards the second region.

Any of these devices may include multiple plugs of shape memory alloy having different transition temperatures, and/or plugs formed of different regions of shape memory alloy having different transition temperatures. For example, any of these apparatuses may include a first plug of shape memory alloy and a second plug of shape memory alloy that is adjacent to the first plug of shape memory alloy; the second plug of shape memory alloy may comprise a martensitic phase shape having an outer diameter that is between $D_1$ and $D_2$ and an austenitic phase shape having an outer diameter that is less than or equal to $D_2$, further wherein a transition temperature between the martensitic and the austenitic phase shape for the second plug of shape memory alloy is different than a transition temperature between the martensitic and austenitic phase shape for the first plug of shape memory alloy. The plug of shape memory alloy may comprise a first region comprising a first transition temperature for transitioning between the martensitic and the austenitic phase shape and a second region having a second phase transition temperature for transitioning between the martensitic and the austenitic phase shape, further wherein the first region is on an opposite end of the plug of shape memory alloy relative to the second region.

Any of these devices may include a fluid passageway configured to connect to a source of pressurized fluid, wherein the fluid passageway is coupled to the valve so that when the temperature exceeds a transition temperature between the martensitic and austenitic phase shape for the plug of shape memory alloy, the plug moves from the first region to the second region within the tube and opens the fluid passageway.

For example, a thermally activated release device may include: an actuator comprising: a first tube having an elastically deformed first region of inner diameter $D_1$ in fluid communication with a relaxed second inner region of inner diameter $D_2$, wherein $D_2$ is less than $D_1$; a plug of shape memory alloy within the first region of the tube, wherein the plug comprises a martensitic phase shape having an outer diameter that is $D_1$ and an austenitic phase shape having a diameter that is less than $D_2$; and a second tube circumferentially fitting over at least the first region of the first tube, wherein the second tube is locked against the first tube when the plug of shape memory alloy is in the martensitic phase shape; further wherein the actuator is configured so that a temperature change causes the second tube to move telescopically when a temperature change transitions the plug from the martensitic phase shape to the austenitic phase shape allowing the inner diameter of the first region to contract to a diameter between $D_1$ and $D_2$; and a valve coupled to the second tube of the actuator.

As mentioned above, a circumferential side wall of the plug fits snugly against an inner wall of the first region. A region of the second tube circumferentially fitting over at least the first region of the first tube may be elastically deformed. For example, the region of the second tube that is circumferentially fit over at least the first region of the first tube when the plug of shape memory alloy is in the martensitic phase shape may be plastically deformed.

In any of these devices, the valve may be configured to open or to close when the plug changes to the austenitic phase. For example, the device may be configured so that the valve opens when the plug changes to the austenitic phase.

Any of the thermally activated release devices may be configured as part of a fire sprinkler valve comprising a valve body configured to connect to a pressurized fluid source that is restrained when the plug is in the martensitic phase shape and released when the plug is in the austenitic phase shape.

Also described herein are methods of actuating a valve comprising: changing the diameter of a plug located within a channel of a first tube from a martensitic phase shape having a first outer diameter and a first length to an austenitic phase shape having a second outer diameter and a second length that is greater than the first length, when the temperature of the plug exceeds a transition temperature, wherein the plug plastically deforms the channel of the first tube in the martensitic phase shape; reducing the diameter of the channel of the first tube when the plug changes from the first outer diameter to the second outer diameter to release a second tube that is circumferentially locked over the first tube while the plug is in the martensitic phase, so that the second tube may slide over the first tube after the diameter of the channel of the first tube is reduced; wherein the valve is actuated by the sliding of the second tube over the first tube. Changing the diameter of the plug may include changing the diameter of the plug from the first to the second diameter when the temperature of the plug exceeds a transition temperature between about 79 and about 107° C.

BRIEF DESCRIPTION OF THE DRAWINGS

FIGS. 7A and 7B illustrate the variation of FIGS. 6C and 6D with a biasing element driving the movement of the plug member at activation.

FIG. 8 illustrates another variation of a plug element.

FIG. 11C shows the release of the plug by transitioning to a higher temperature, allowing the plug to resume its contracted form and pass through the channel.

DETAILED DESCRIPTION

In general, described herein are thermally actuated release devices and methods for actuating them. For example, described herein are devices that are configured so that a plug element is displaced within a channel when the temperature exceeds some threshold value. The plug typically has a first configuration with a first diameter and a second configuration with a second (typically narrower than the first) diameter. After transitioning from the wider to the narrower diameter, the plug moves from a larger diameter region in the device into or through a narrower diameter region in the device after the plug changes to the narrower diameter. The displacement of the plug may be coupled to a release mechanism. For example, displacement of the plug may release a valve, allow fluid to flow; in the un-released state the valve may be held even against an applied pressure (e.g., fluid pressure).

In general, the shape-changing plug elements described herein may be formed of a shape memory material such as a shape memory alloy component that undergoes a significant size change in at least one axis when by application of heat. Hyperelastic shape memory materials may be of particularly use, because the hyperelastic properties are particularly well suited for these devices and systems. Examples of hyperelastic materials include single-crystal shape memory alloys such as single-crystal CuAlNi. For example, a hyperelastic alloy may be formed as single crystals of approximately Cu(84)Al(14)Ni(4) wt. %. Other shape memory alloys (including either the polycrystalline or single-crystal forms of such alloys) may include CuAlMn and/or CuAlBe.

Figure 10A:
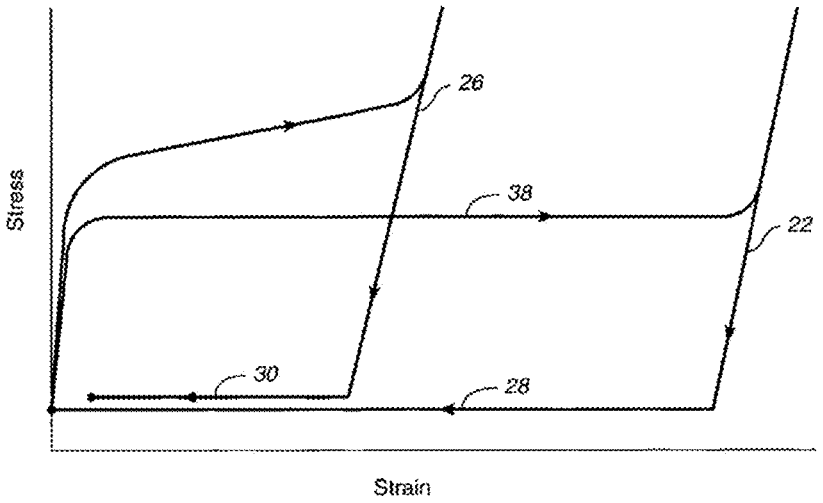
FIGS. 10A and 10B show the stress-strain curves for an exemplary hyperelastic material (e.g., CuAlNi single crystal) as well for a polycrystal TiNi SMA. Solid line curve 20 shows the hyperelastic (single crystal) SMA material in its austenitic phase while curve 22 shows the martensitic phase. Solid line curve 24 shows the polycrystal SMA in its austenitic phase while curve 26 shows the martensitic phase. The graphs show the comparisons between the two SMAs as explained in the following. The objective of this invention is to provide a simpler, more reliable, and more mechanically robust means and apparatus for controlling conflagration than is currently available.
Figure 10B:
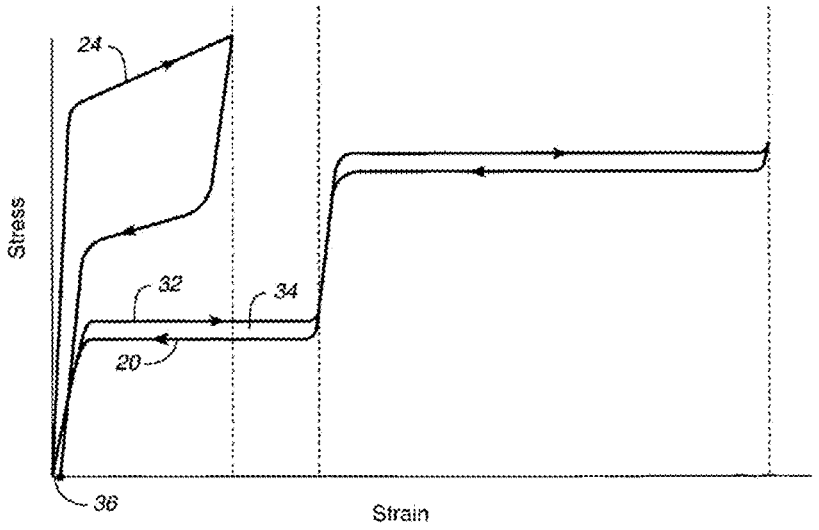

As used herein, hyperelastic materials are understood by their properties to include shape memory alloy materials. For example, hyperelastic materials typically exhibit greater than 9 percent strain recovery. For example, in FIG. 10A, the region 28 of curve 22 for the austenitic phase of the exemplary hyperelastic SMA (single crystal CuAlNi) shows the magnitude of its strain recovery in comparison to a comparable region 30 of curve 26 for an austenitic polycrystal SMA. There is a three-fold gain in performance over the conventional SMA materials made from bulk materials, such as TiNi. Depending on how the sample is used, the greater than 9 percent recovery can either be used in the high temperature state (when in austenite phase), or deformed 9 percent (when in Martensitic phase) and then heated to recovery as an actuator. The range of strain recovery is far beyond the maximum strain recovery of both conventional polycrystalline SMA materials and non-SMA metals and alloys. In the context of the devices described herein, a hyperelasstic (e.g., single crystal) shape memory alloy forming the plug element may have a number of advantages over polycrystalline shape memory alloys, such as the precision at which the transition between martensite and austenite occurs, the near-instantaneous nature of the transformation and the choice of and/or the ability to set the transition temperature of the plug element. For example, a single crystal material, because it is uniformly oriented, will transform synchronously over the structure. In contrast, a polycrystalline material, which will have different orientations of the alloy, will not transform over the entire body simultaneously, because the whole body won't see all of the same stresses at the same time because of the differently oriented regions. The ability of the single-crystal SMA to transform all at once may result in a larger force per time, which may also be beneficial. Finally, the range of transition temperatures for single crystal shape memory alloy materials may be much broader than polycrystalline materials, Hyperelastic materials also exhibit true constant force deflection. Unlike polycrystalline materials which reach their strain/stress plateau strength in a gradual fashion and maintain an upward slope when deformed further, hyperelastic SMA materials have a very sharp and clear plateau strain/stress that provides a truly flat spring rate when deformed up to 9 percent. This is shown in FIG. 10B by the region 32 of curve 20. The stress level at which the plateau occurs depends on the temperature difference between the transformation temperature and the loading temperature. Additionally, a single crystal SMA may also exhibit a hyperelasticity benefit from a second stress plateau which can increase the total recoverable strain to 22 percent.

Hyperelastic materials may also exhibit very narrow loading-unloading hysteresis. As a result, there is substantially the same constant force spring rate during both loading (increasing stress) and unloading (decreasing stress). This is shown in FIG. 10B by the narrow vertical spacing 34 between the upper portion of curve 20 which represents loading and the lower portion representing unloading. In comparison, there is a relatively wide spacing between the corresponding loading and unloading portions of curve 24.

Hyperelastic materials may also exhibit recovery which is 100 percent repeatable and complete. In contrast, polycrystalline SMA materials may exhibit "settling" that occurs as the material is cycled back and forth. This is shown in FIG. 10B for curve 24 by the spacing 36 of the curve end representing the beginning of the loading and the curve end representing the end of the unloading. The settling has required that the material be either "trained" as part of the manufacturing process, or designed into the application such that the permanent deformation which occurs over the first several cycles does not adversely affect the function of the device. By comparison, hyperelastic SMA materials do not develop such permanent deformations and therefore significantly simplify the design process into various applications. This is shown in FIG. 10B where the beginning of curve 20 representing unloading coincides with the end of the curve representing loading.

Hyperelastic materials may also have low yield strength when martensitic. This property is shown by the horizontal portion 38 of curve 22, which is relatively much lower than the corresponding portion of curve 26, in FIG. 10A. Hyperelastic materials may also have an ultra-low transition temperature. For example, hyperelastic SMA materials made from CuAlNi can be manufactured with transition temperatures close to absolute zero (−270 Celsius). This compares to SMA materials made from TiNi which have a practical transition temperature limit of −100 Celsius. As mentioned above, the advantage from hyperelastic SMA may allow the release devices described herein to have a set transition temperature over a very broad range of values, including for use in cryogenic applications.

At higher temperature ranges, a hyperelastic (e.g., single crystal) SMA may typically display a higher transition temperature than polycrystalline SMAs. For example, the upper range for transition temperatures of TiNi is typically around 100° C., while for CuAlNi, the transition temperature may be greater than 300° C.

Hyperelastic material may also exhibit intrinsic hyperelastic properties. For example, compared with TiNi SMA, which can be conditioned, through a combination of alloying, heat treatment and cold working, to have superelastic properties, single crystal CuAlNi SMA materials have intrinsic hyperelastic properties. A crystal of CuAlNi is hyperelastic immediately after being formed (pulled and quenched) with no further processing required.

Thus, materials exhibiting hyperelastic properties are referred to herein as hyperelastic materials. Such single crystals may be formed as extruded shapes whether by pulling from melt or by continuous casting. The fabrication and performance of such single crystal SMA materials are disclosed in U.S. application Ser. No. 10/588,413 filed Jul. 31, 2006. Reference is also made to U.S. Pat. No. 7,842,143, herein incorporated by reference in its entirety. For example, a single-crystal CuAlNi may be drawn from melt and cooled by use of the Stepanov method. Shape memory and hyperelastic properties may be set by heating to a temperature high enough to dissolve the precipitates, followed immediately by rapid cooling ("quenching") to lock in the dissolved elemental components. Single crystals pulled from melt may have an as-formed or extruded shape such as a solid or hollow cylindrical shape with a constant cross-sectional form. It is sometimes advantageous to alter the fabricated shape into a shape more suited to a particular application. Any of the plug elements described herein may be fabricated and shape- and temperature-set to achieve the characteristics described herein.

Certain shape memory alloys, made as a single crystal, exhibit very large strains at constant stress due to stress-induced Martensite. These alloys, described in U.S. Pat. No. 7,632,361 and elsewhere (incorporated herein by reference) as Hyperelastic SMAs, may be used to form the plug elements described herein.

Thus, in some variations herein described, a relatively small component of the devices or system (e.g., plug element) are made of hyperelastic single crystal alloy that is lodged within a channel and securely holds a valve closed by mechanical interference with a second component until sufficient heat is applied to cause the component (e.g., plug) to revert to a narrow-diameter phase in which it gets displaced within the channel, and may release the valve, allowing it to open. Single-crystal (e.g., hyperelastic) SMAs may be particularly helpful, because they permit an extremely rapid and reliable transition.

The plug element in the lower temperature form may be any appropriate size(s), including any appropriate diameters. For example, the plug element may be between 0.1 mm and 50 mm in diameter. The plug element may also be any appropriate length. For example, the plug element may be between about 0.1 mm and about 100 mm long. Because of the Poisson's ratio for a shape memory alloy is about ⅓, compression of the plug in a first direction (e.g., length) results in expansion of the plug in the transverse direction (e.g., width). Thus, the greater the force of gravity, a bias, or fluid pressure on the plug element may more securely hold the plug element in the channel. Given the Poisson's relationship, as the plug is compressed within the housing, the width increases slightly. Above the transition temperature the plug element may convert to a shape having a smaller diameter (e.g., width) than the opening in the channel, even given the Poisson relationship, so that the plug element can fall through the channel sufficiently far enough to actuate the valve, even against the applied force. As described in more detail below, the plug element may be CuAlNi with a phase transition temperature near the specified actuation temperature of the device (e.g., in sprinkler valve embodiments, near the actuation temperature of the sprinkler head).

As mentioned above, in general, the devices and systems described herein are thermally activated release devices and system including them. These thermally activated release devices typically include a material that has been configured to change shape from a first shape having a first diameter into a second shape having a second, narrower, diameter, above a predetermined temperature. This shape-changing material may be a shape memory alloy, and in particular a hyperelastic shape memory alloy. The shape-changing material is typically configured as a plug (plug element) that is initially retained in a channel having a region of first diameter that is greater than or equal to the diameter of the plug in the first (e.g., martensitic) configuration. The channel is connected to a second region having a narrow diameter that is smaller than the diameter of the plug in the first configuration. The second region is offset from the first region, so that at the transition temperature, when the plug element switches shape from the first diameter (wide) shape into the second diameter (narrow) shape, the plug element may move from the first region into the second region. For example, a biasing element may be included to drive the plug from the first region to the second region. The movement of the plug from the first region to the second region is the thermally activated release of the device. The movement or displacement of the plug may be tied to one or more actuations. For example, the displacement of the plug may cause release of a valved fluid (liquid, gas, etc.).

Figure 1:
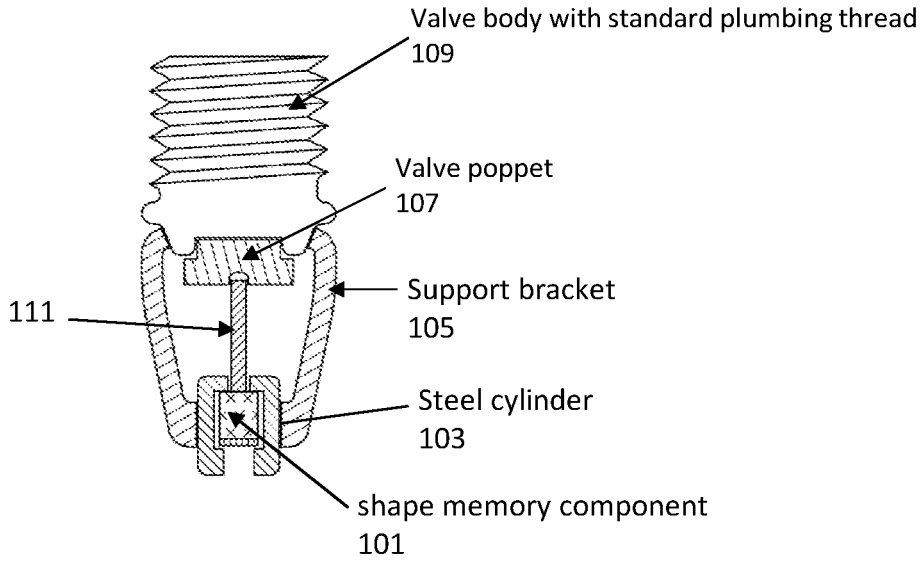
FIG. 1 is one example of a thermally activated release device that is configured as a sprinkler valve.

FIG. 1 illustrates one variation of a thermally activated release device configured as part of a sprinkler valve, in which the thermally activated release device is connected to a pin 111 and valve poppet 107. The thermally activated release device includes a steel cylinder 103 including a channel having a first inner diameter region connected to a second inner diameter region (where the first diameter is greater than the second diameter). A support bracket 105 is included in this embodiment to hold the thermally activated release device to a threaded valve body 109 that can be attached to a fluid source. The thermally activated release device may include a hyperelastic SMA plug element 101 within the cylinder 103 forming the internal channel having two (or more) regions of different diameter. A sprinkler valve embodiment may also include any additional sprinkler valve elements, including deflection/water guidance elements, and the like.

Figure 2:
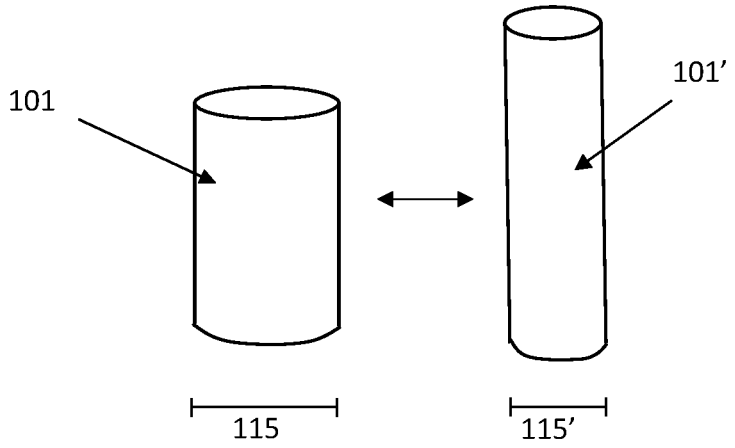
FIG. 2 illustrates one variation of a plug element converting from a first diameter (e.g., martensitic form) to a narrower second diameter (e.g., austenitic) form.

In operation, a sprinkler valve variation including a thermally activated release device may be attached to a fluid source, and particularly a pressurized fluid source. At temperatures below the activation or transition temperature, the valve prevents the pressurized fluid from passing through the sprinkler device. Thus, the valve may be attached or secured to the pressurized fluid source by any appropriate method, such as a threaded valve body. The fluid source may be blocked by a valve element such as the valve poppet that is prevented from opening and allowing fluid to flow out of the fluid source by the thermally activated release device. In FIG. 1, the pin element 111 is connected to the valve poppet and the thermally displaceable plug 101. Below the transition temperature of the hyperelastic SMA plug 101, the plug is held securely in the upper region of the channel formed in the stainless steel cylinder 103. In this position, the pin 111 is held against the valve poppet 107, preventing the valve poppet from opening. At or above the transition temperature, the SMA plug 101 changes from the larger diameter configuration to a narrower-diameter configuration, as illustrated in FIG. 2. In FIG. 2, the larger-diameter 101 configuration is configured as a cylindrical shape with a diameter ($d_1$) 115 in the martensitic phase. Above the transition/activation temperature the plug is transformed into a narrower-diameter configuration 101' with a diameter ($d_2$) 115' in the austenitic phase; the $d_2$ diameter is less than the $d_1$ diameter.

As used herein, the diameter of the plug element may refer to the cross-sectional distance (actual, average, minimum, or maximum) through the plug element that is aligned in common with the channel passage into which the plug element is positioned. Thus, in FIG. 2 the diameter referred to is the diameter transverse to the elongate cylindrical shape (e.g., a circular section). This diameter matches the diameter of the one or more regions of the channel of the thermally activated release device in which the plug sits. In other plug examples, the diameter may refer to the maximum diameter of an elliptical cross-section, square cross-section, rectangular cross-section, etc.

In general, in any of the thermally activated release devices described herein, the devices include a channel in which the plug element is housed. The plug element may preferably be housed within the channel, and may be partially enclosed. Until activation by transitioning to or past the transition temperature, the plug element is held within a first region of the channel. In some variations the plug may be sealed or enclosed within this first region of the channel. In other variations, the plug may be held within the first region of the channel by a bias or biasing member (e.g., spring element).

Figure 3A:
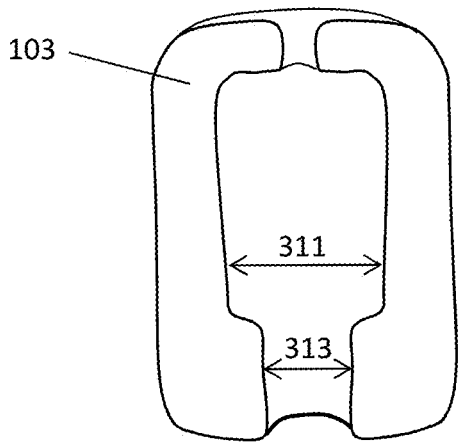
FIG. 3A illustrates a cross-section through a portion of one variation of a thermally activated release device including a channel having regions of different diameter.
Figure 3B:
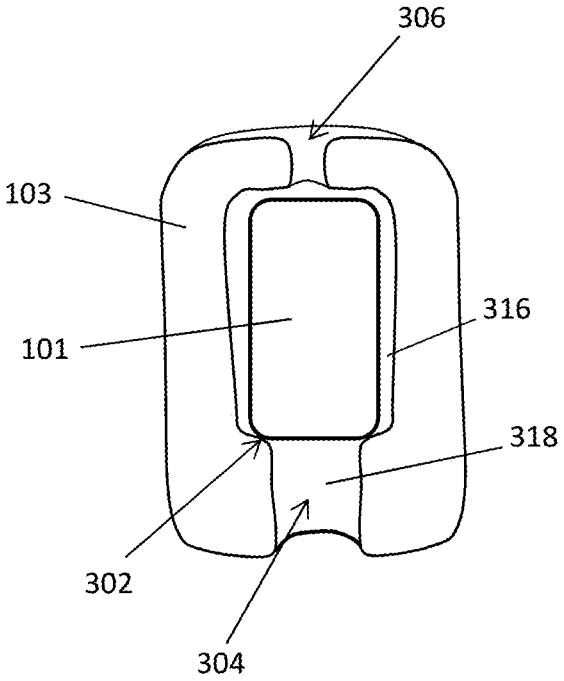
FIGS. 3B and 3C illustrate the thermally activated release device of FIG. 3A, showing release of a plug element such as the one shown in FIG. 2 from the inner channel of a housing.
Figure 3C:
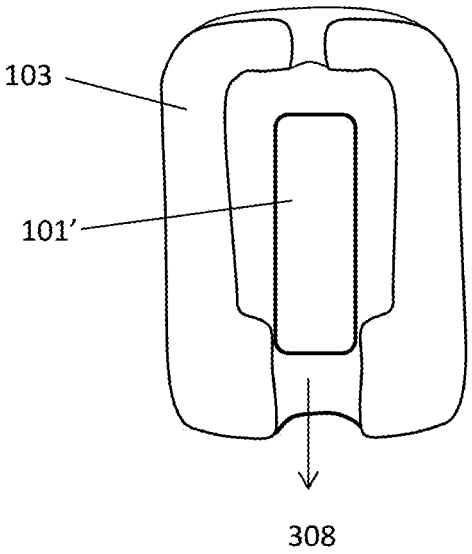

FIG. 3A shows one variation of a housing for a thermally activated release device that includes a channel having two distinct regions of internal diameter to secure the plug element both during the low-temperature, larger diameter configuration and the high-temperature, smaller-diameter configuration of the plug. The channel is arranged to allow movement of the plug from the larger-diameter first region into an adjacent, narrower diameter, second region that is continuously connected with the first region of the channel. In FIG. 3A, the housing includes a larger upper housing region 311 that is continuously connected to a smaller/narrower diameter lower housing region 313. FIGS. 3B and 3C illustrate the transition from the martensitic to the austenitic forms of the plug while the plug is within the thermally activated release device. Before actuation, the larger-diameter plug element 101 is secured within a larger-diameter region of the channel through the housing 103. In some variations the plug may completely fill the first region when the plug is in the (lower temperature) first configuration. In some configurations, the plug does not completely fill the first region. The plug element may be connected to a pin, valve, brace, or the like, such that displacement of the plug element as it transitions from the first region of the channel to the second region (at or above the transition temperature) releases or actuates the pin, valve, brace, or the like.

As shown in FIGS. 3B and 3C, when the temperature reaches and exceeds the activation temperature, the plug element 101 is able to move from the first chamber 316 into the second chamber 318. The channel shown in FIGS. 3A-3C includes an upper opening 306, which may allow the plug to connect to a pin, valve, brace, or the like, though the opening 306. The channel is formed within a housing 103, including the upper, larger-diameter chamber 316, and lower, narrower-diameter chamber 318. The channel and housing may be open at the opposite end of the housing 304. In some variations, the plug element may be released from the channel, and the housing forming the channel, out of this opening 304. In some variations this opening 304 is as large as (or larger than) the diameter of the plug element and/or second chamber. Thus, the plug element may extend out of the thermally activated release device after activation. In some variations the thermally activated release device includes a second or lower opening 304, however the opening is smaller than the diameter of the plug element and/or the second chamber, and thus plug element is retained within the second chamber after activation.

In FIGS. 3B and 3C the transition 302 between the first 316 and second 318 chambers is a rounded shoulder. As mentioned, this transition region may be more or less gradual. For example, the transition may be a ramped region.

In FIGS. 3A to 3C, the first and second chamber regions are distinct regions that include a transition region (e.g., shouldered region) between them. For example, the first and second regions extended through the channel to form regions having relatively constant diameters (and/or cross-sections) as shown in FIGS. 3A to 3C. In some variations the first and second regions are formed as part of a continuously narrowing channel. Thus, the first region and/or the second region is formed of a channel having a decreasing (rather than constant over a range) inner diameter. In general, the second chamber has a diameter that is less than the first region. An example of a thermally activated release device having a channel with a non-cylindrical second diameter region (in which the diameter of the second chamber decreases as the channel extends from the first region) is shown and described below in FIGS. 6A-7B.

Figure 4A:
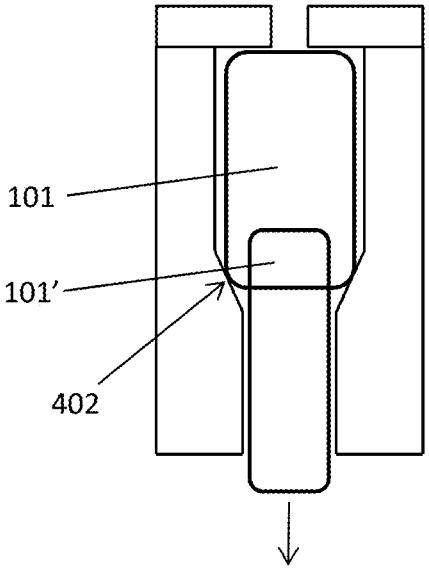
FIG. 4A shows a cross-section through another variation of a thermally activated release device including an inner channel that transitions from a first (larger) diameter region, gradually into a second (narrower) diameter region. The diameter of the plug element in the first configuration is smaller than the first diameter or the channel, but larger than the second diameter of the channel, and thus the plug is held up in the channel until it transitions at a predetermined transition temperature to a narrower-diameter configuration and passes into the lower and narrower region of the channel having the second diameter, since the diameter of the plug in the second configuration is narrower or the same as the second diameter of the channel.
Figure 4B:
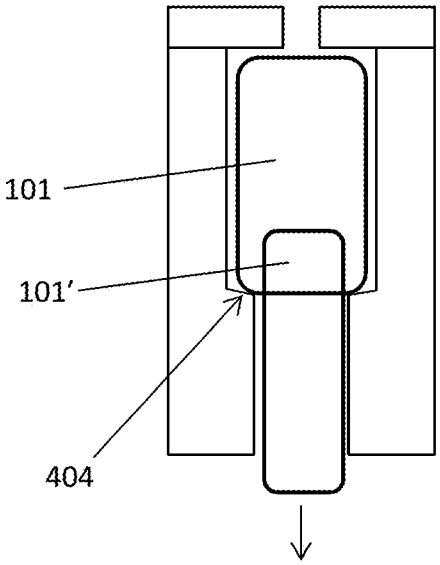
FIG. 4B shows a cross-section through a similar thermally activated release device variation to that shown in FIG. 4A, in which the transition between the first larger diameter region and the second narrower diameter region is steep, resulting in a rim or lip region.

FIGS. 4A and 4B illustrate two exemplary variations of thermally activated release devices shown in cross-section. The plug element is drawn (overlapping) in both the martensitic 101 (rest) and austenitic 101' (activated) forms. In FIG. 4A, the thermally activated release device includes a somewhat gradually ramped transition 402 between the first region and the second region of the passage. In contrast, in FIG. 4B the transition region between the first and second regions is a lip or ledge region 404. In this example, a plug element may be held within the first chamber in the first (e.g., martensitic) 101 configuration so that it rests against the lip or ledge 404. After transition to the second (e.g., austenitic) 101' configuration, the plug element drops down into the second region; in FIGS. 4A and 4B the plug may drop out of the channel.

Alternatively, in some variations, as an alternative to a ledge or lip region, the device may include, instead of a single ring, a mating surface be a helical 'spiral staircase' configuration. The two parts may then be threaded together, and the surface area of the 'circular staircase' may be much larger than a single ring/lip region. This may reduce stress on the actuator.

In FIGS. 4A and 4B, the plug element may be driven from the first (larger diameter) chamber into the second (smaller-diameter) chamber after the diameter of the plug element is reduced, by dropping from the upper chamber to the second chamber, when the second chamber is positioned below the first chamber, permitting gravity to drive the plug element.

Figure 5A:
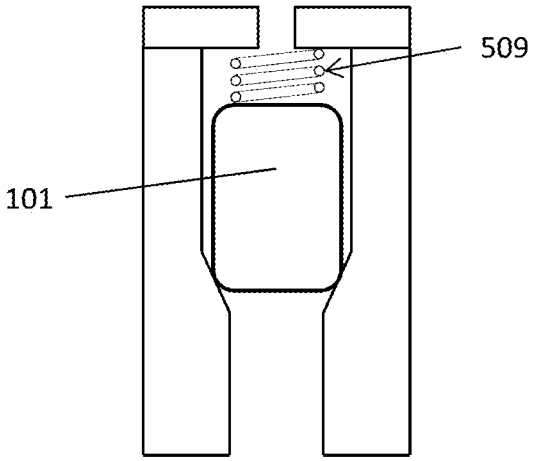
FIGS. 5A and 5B show another variation of a portion of a thermally activated release device, shown in cross-section, before (in FIG. 5A) and after (FIG. 5B) activation; this variation includes a biasing element driving the movement of the plug element during activation.
Figure 5B:
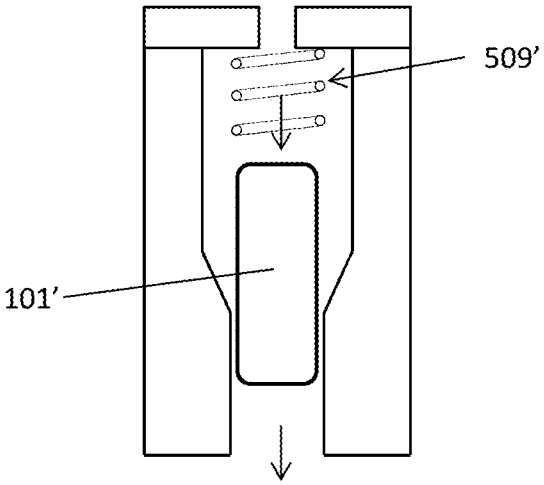

In some variations, the thermally activated release device may include a bias or biases that help drive the plug element from the first chamber to the second chamber, as illustrated in FIGS. 5A and 5B. FIGS. 5A and 5B resemble the configuration shown in FIG. 4A, above, with the addition of a biasing element 509. The biasing element shown is a coil spring 509. The coil spring in FIG. 5A applies a bias against the plug element, which will (once the plug element transitions to the higher temperature, activated configuration) drive the plug element into the smaller-diameter second region, as shown in FIG. 5B.

Figure 5C:
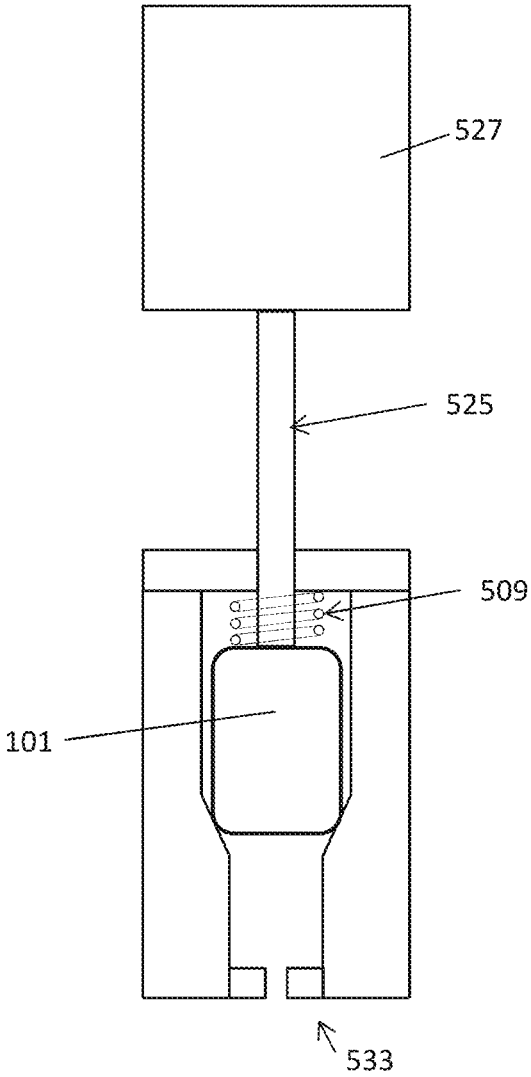
FIGS. 5C and 5D illustrate FIGS. 5A and 5B, respectively, including a pin element that is released by activation of the thermally activated release device.
Figure 5D:
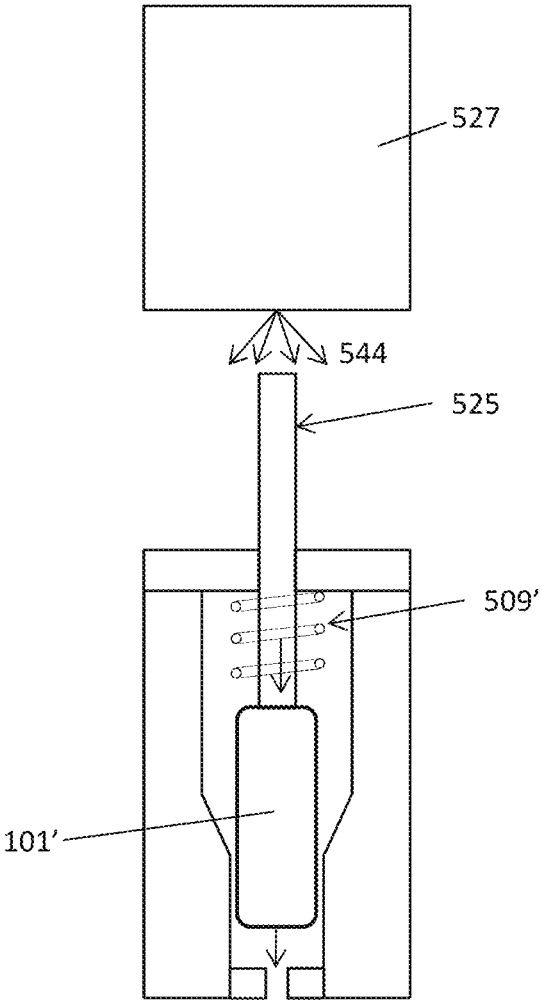

FIGS. 5C and 5D show the thermally actuated release devices of FIGS. 5A and 5B, respectively, including a pin element 525 that is released by activation of the thermally activated release device. In this example, the channel also includes a stop 533 at the base that prevents the plug element from falling completely out of the channel. This example of the stop 533 includes an opening or hole that is of a smaller diameter than even the diameter of the plug in the high-temperature configuration (in FIG. 5D); the opening may prevent pressure from slowing or blocking the activation of the plug element. In some variations the stop may be integrally formed as part of the housing surrounding the channel.

In operation, in FIG. 5C, the thermally activated release device is held in a closed position so that the pin element 525 is secured against the block element 527. Block element 527 is shown as merely a schematic in the figure, and may be any structure that is secured and then opened or released by the thermally activated release device (e.g., a workpiece, channel, pipe, opening, latch, etc.). The bias 509 pushes against the plug element 101, but below the transition temperature the plug remains within the wider diameter (upper) portion of the channel, holding the pin element 525 securely against the block element 527. As mentioned, force may be applied by the pin element against the plug element 101, such as fluid pressure if the pin element is holding back a fluid. This force may further secure the plug in the channel, because the Poisson's ratio means that the compressive force (stress) on the plug element results in an expansion of the diameter of the plug element.

Above the transition temperature of the plug element 101, the plug element transforms into the configuration shown in FIG. 5D, so that the plug element 101' can then move into the narrower diameter region of the channel; in this example the bias 509' helps drive the plug element down (arrow). The stop 533 prevents the plug element from falling out of the channel completely. In FIG. 5D, moving the plug element 101' further into the channel allows the pin element 525 to move away from the block element 527; in this example, this allows release of material (e.g., fluid) from the block element (arrows 544). For example, the block element 527 may include an opening or outlet that is blocked by the pin element 525 until release by activation of the thermally activated release device above the transition temperature.

In any of the variations described herein, the thermally activated release device may be resettable. Resetting may involve cooling below the transition temperature so that the plug element moves back into the first portion of the passageway, and may also include compressing (e.g., inducing stress-induced martensite) to increase the diameter of the plug element due to the Poisson's ratio. For example, in FIGS. 5C and 5D, the thermally activated release device may switch from the closed (FIG. 5C) and open or released (FIG. 5D) configuration, and then be reset back to the closed (FIG. 5C) configuration. In other variations the device may be configured so that it is not resettable, but is single-activation only. For example, release of the thermally activated release device may cause one or more elements (e.g., the pin element, the plug element, etc.) to fall way from the device.

Figure 6A:
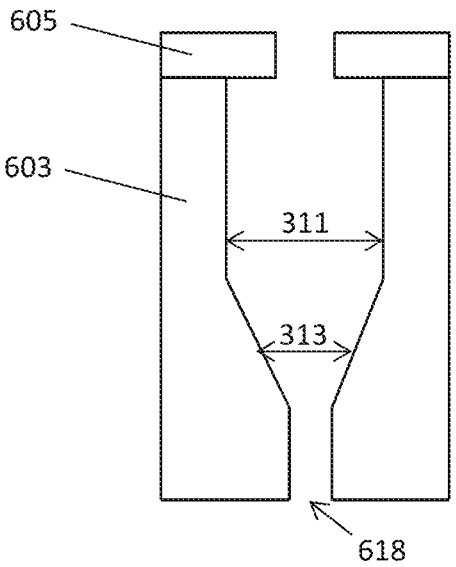
FIGS. 6A and 6B show two variations of portions of thermally activated release devices, each including a passage having a first inner diameter region and a second region having a second inner diameter that is less than the first inner diameter.
Figure 6B:
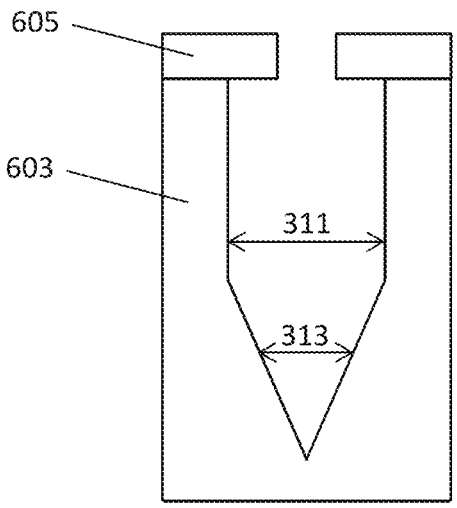

FIGS. 6A and 6B illustrate another variation of a thermally activated release device in which the channel is formed within the housing 603 to have an upper region of a first diameter 311 and a tapering second region having a decreasing second diameter. The second region has an average diameter that is less than the first diameter. In some variations (such as the variation shown in FIG. 6B), the second diameter includes a region (longitudinally down the length of the channel) separated from the first region that has a diameter that is approximately the same as the diameter of the plug element in the second configuration. In some variations the diameter of the second region is greater than the diameter of the plug's second configuration, though the second region may terminate in a stop.

Figure 6C:
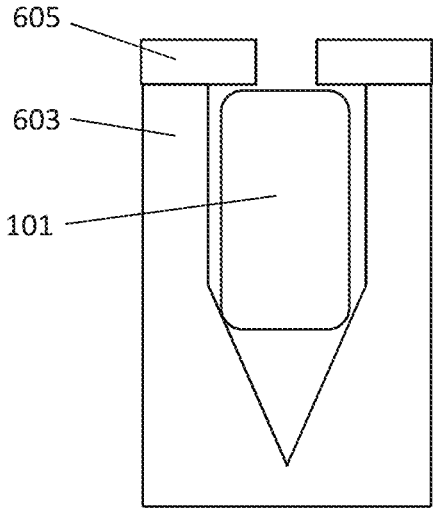
FIGS. 6C and 6D show the variation of FIG. 6B including a plug element, before (FIG. 6C) and after (FIG. 6D) activation.
Figure 6D:
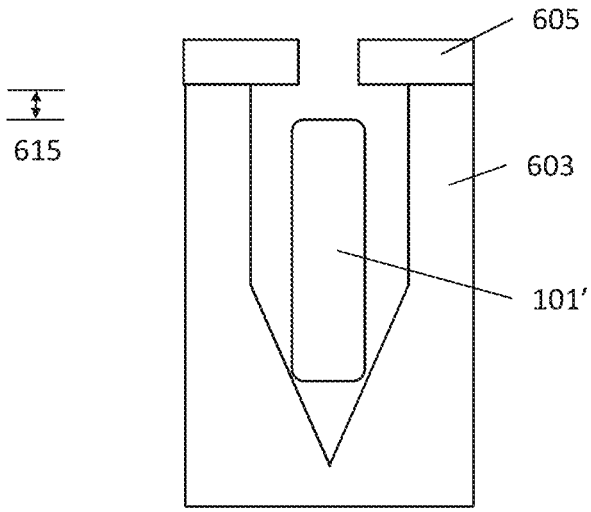

FIGS. 6C and 6D illustrate operation of a thermally activated release device configured as described above, including illustrating a transition from a thermally activated release device including a plug element within the first region in FIG. 6C that transitions to a plug element that has moved to the second region as shown in FIG. 6D. In this transition the plug element is displaced longitudinally (along a "z" axis) by an amount illustrated (as 615) between FIGS. 6C and 6D.

FIGS. 7A and 7B show the exemplary variation of FIG. 6A-6D including a biasing element 709, 709' shown here as a coil spring. The biasing element includes any appropriate member that may apply force to drive the plug element from the first to the second regions of the passage thorough the housing. Other biasing elements include non-coil springs (e.g. leaf springs, etc.), magnetic biasing elements, etc.

As already mentioned, the plug element may be any appropriate plug element. The plug element may have any appropriate shape. For example, in FIG. 8, the plug element is shown as an ovoid element having a rounded proximal and distal ends. In FIG. 2 the plug element is a cylinder. In general the plug element may be configured to change shape at a predetermined temperature from a larger-diameter low-temperature form to a smaller-diameter austenitic form.

Figure 9:
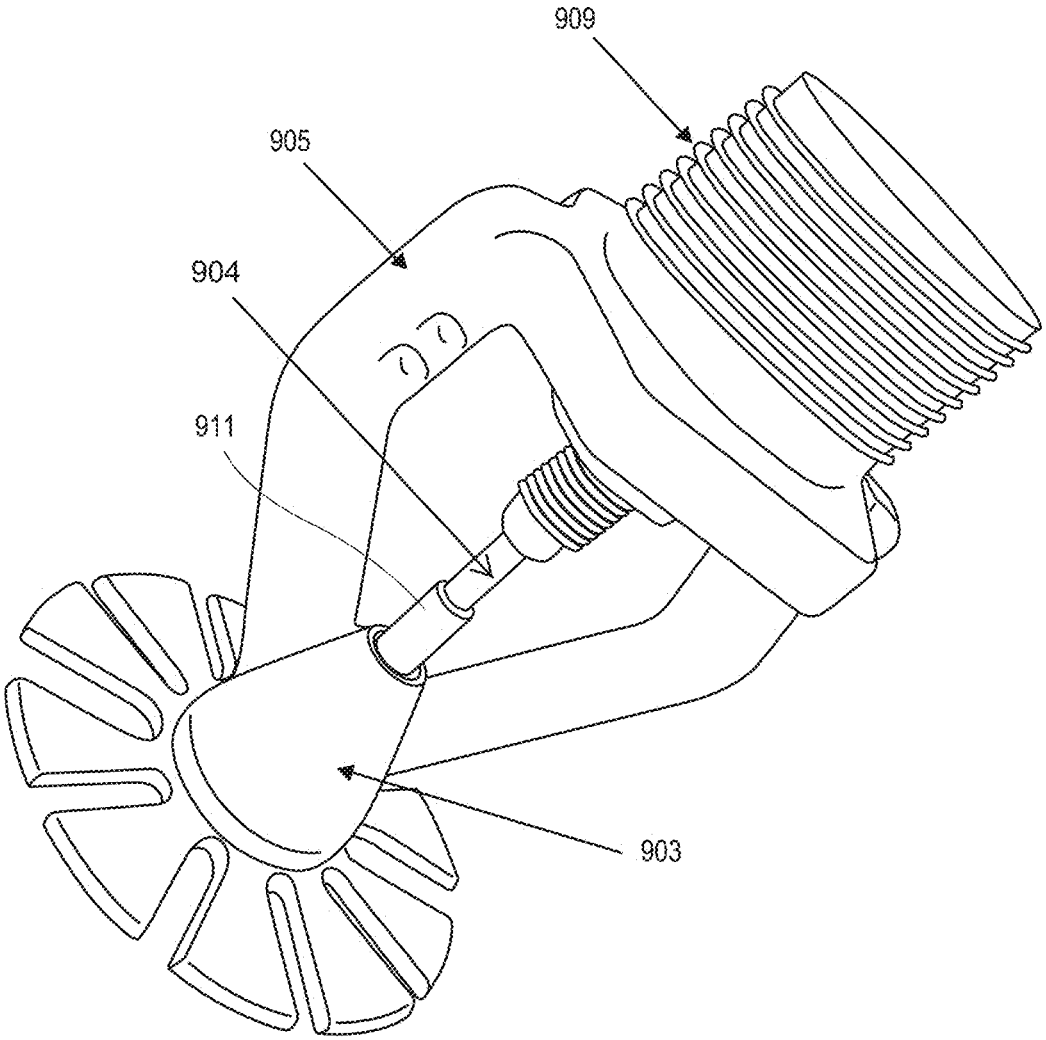
FIG. 9 shows one variation of a sprinkler valve including a thermally activated release device such as those described above.

As described in FIG. 1, the thermally activated release device may be configured as a sprinkler valve assembly. FIG. 9 shows a side perspective view of one variation of a sprinkler valve assembly. In this variation, the sprinkler valve includes an integrated thermally activated release device 903 to which a pin 904 is connected. The pin 904 connects to a poppet valve (not shown) to prevent water flow until release of the ping by displacement of the plug element within the thermally activated release device (subassembly). In FIG. 9, the housing in which the channel of the thermally activated release device 903 is formed into the brace 905 of the sprinkler valve. As mentioned above, the sprinkler head may include a threaded attachment region 909 as well as addition elements for directing water flow once the valve is released.

Figure 11A:
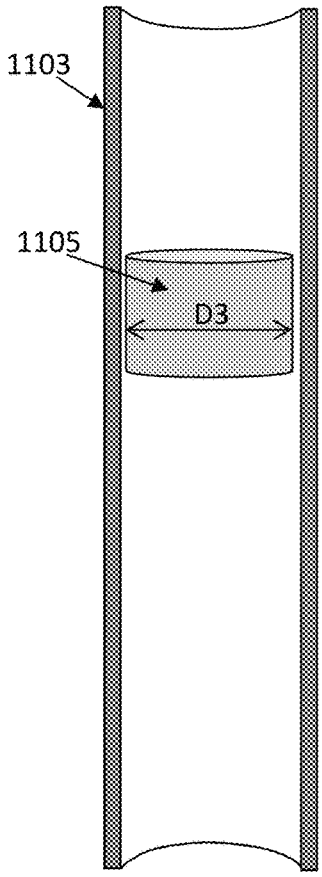
FIGS. 11A-11C illustrate the operation of another example of a thermally activated release device, configured to be set into a locked position (shown in FIG. 11B) by deforming a shape memory alloy (SMA) plug within the channel (e.g., tube) to be releasably blocked at low temperatures.
Figure 11B:
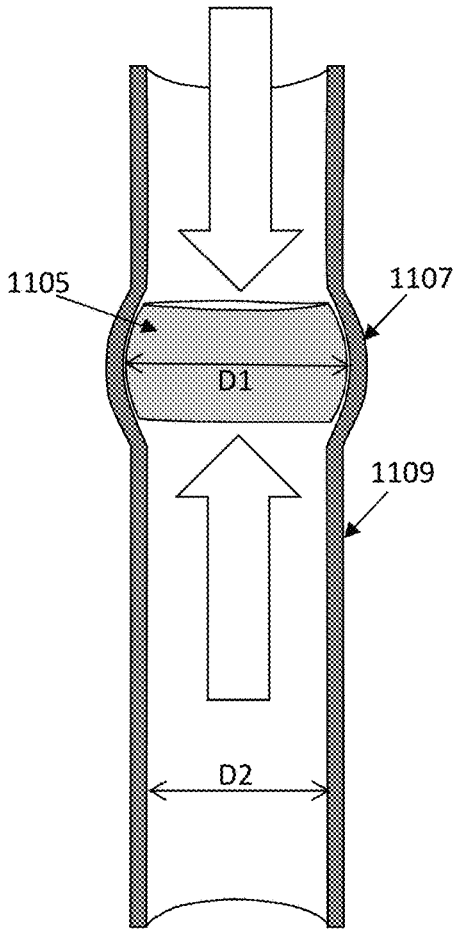
Figure 11C:
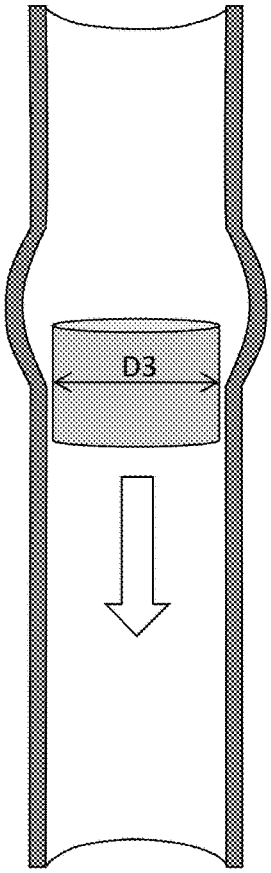

FIGS. 11A-11C illustrate the operation of another variation of a thermally activated release device as described herein. In FIG. 11A, the device may include a tube and an plug of shape memory alloy as described above. In this example, the plug may be compressed while in the tube 1103 so that the tube is blocked, as shown in FIG. 11B (arrows) the plug 1105 may be compressed by applying force on either side of the plug to compress it so that the sidewalls of the plug bulge outward and deform the inner wall of the tube. Alternatively, the plug may be inserted into the tube in the austenitic phase shape that has a smaller diameter (e.g., while heated above the transition temperature) and allowed to cool into the martensitic shape form having the larger diameter. Thus, the mechanism shown in FIG. 11A-11C may form an actuator that may include the tube 1103 and the plug 1105. FIG. 11A shows one method of forming an actuator by adding the plug into the tube, then (in FIG. 11B) expanding (e.g., by compression) the shape memory alloy plug within the tube to form a bulging region 1107 in which the plug 1105 is pressed against the inner wall of the tube. In this example, as above, the tube then forms a first region of inner diameter $D_1$ that is in fluid communication with a second region of inner diameter $D_2$, ($D_2$ is less than $D_1$). In the un-compressed configuration the plug may have a diameter (e.g., $D_3$) that is smaller than the diameter of the tube (e.g., $D_2$), so that it may slide through the tube. In some variations the tube may directly occlude a fluid (e.g., gas, liquid, etc.) from passing through/into the tube. Alternatively or additionally, the plug may be connected to an arm or extension such as a valve poppet. Thus, in FIG. 11B, the plug of shape memory alloy is within the tube. In the martensitic phase shape, the plug has an outer diameter that is between $D_1$ and $D_2$ (including equal to $D_1$) and an austenitic phase shape having an outer diameter that is less than or equal to $D_2$ (e.g., $D_3$), as mentioned above. The actuator is configured so that a temperature change causes the plug to change from the martensitic phase shape to the austenitic phase shape so that the plug releases the side of the tube, and (as shown in FIG. 11C), may move from the first region 1107 to the second region 1109 within the tube, and may fall completely out of the tube in some variations.

A device including the actuator shown in FIGS. 11A-11C may also include a valve that is coupled to the actuator; the valve may open when the plug transitions from a martensitic phase shape (having a diameter that is the same size or larger than the inner diameter of the tube) to a austenitic phase shape (having a diameter that is smaller than the inner diameter of the tube); in some variations, as shown in FIG. 11C, the plug moves from the first region to the second region within the tube.

In this example, a cylindrical plug is shown and may be compressed while it is inside the tube, as described. As the plug is compressed axially, it expands radially, exerting a pressure/force against the inside bore of the tube and increasing the bore diameter. The amount of diameter increase of the bore may depend on the material of the tube, its thickness, elasticity, shape, etc. In this embodiment, the shape memory alloy plug is compressed within a cylindrical tube of uniform diameter. The plug expands and presses against the inside of the tube, enlarging it so that the plug is securely held in place. When heated, the plug becomes smaller in diameter so that it may move axially.

Increasing the bore diameter in this way may provide a contact surface that is shaped to provide the maximum holding force. The shape memory alloy plug presses against the inside of the bore and may have a tapered contact surface between the plug and the tube interior surface. Combined, these may provide more holding force than friction/stiction. The holding force can be adjusted by changing the wall thickness or material of the tube, and/or by cutting longitudinal slots in the tube.

The stress applied to the plug may be distributed evenly, particularly as compared to variations having a lip or ledge. Instead of a single narrow ring of contact, the entire outer surface of the plug is under uniform compressive stress. Compressing the plug inside the tube may also ensure a fit that is very strong: the plug may stretch the tube. This may also prevent miss-alignment within the tube; after actuation the actuator includes just one tube without any discontinuities to inhibit movement.

Figure 12A:
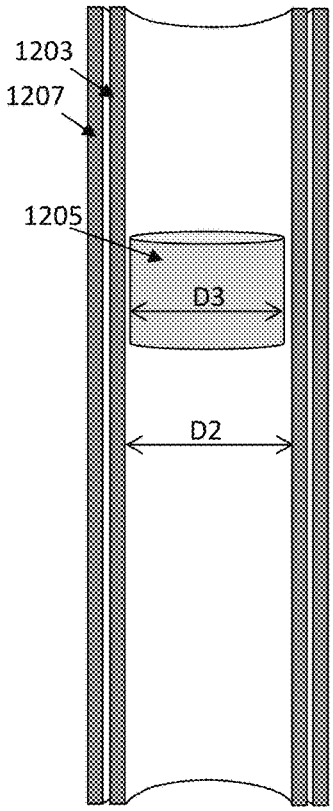
FIGS. 12A-12C illustrate another example of a thermally activated release device, configured as a telescoping release device. As in FIGS. 11A-11C, a shape memory alloy (SMA) plug may be deformed (e.g., compressed) within the tubular channel of the inner tube, locking the inner and outer tubes in place axially (FIG. 12B). When temperature of the plug exceeds the transition temperature of the shape memory material forming the plug, the plug may contract back to un-deformed diameter, allowing the tubes to telescope relative to each other.
Figure 12B:
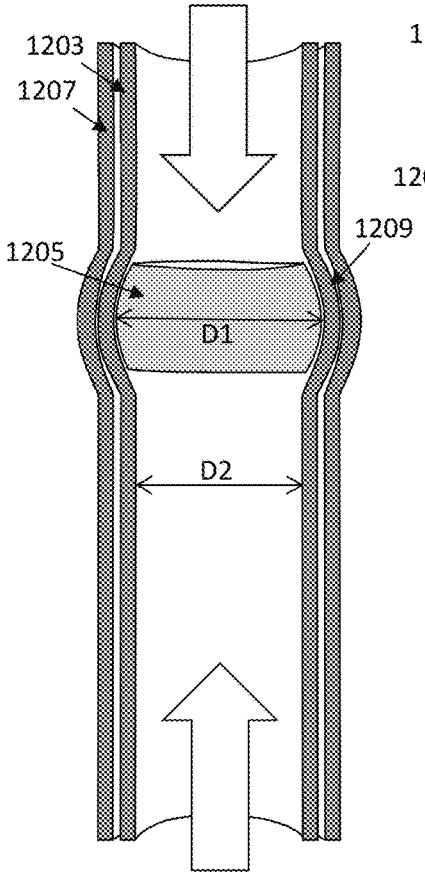
Figure 12C:
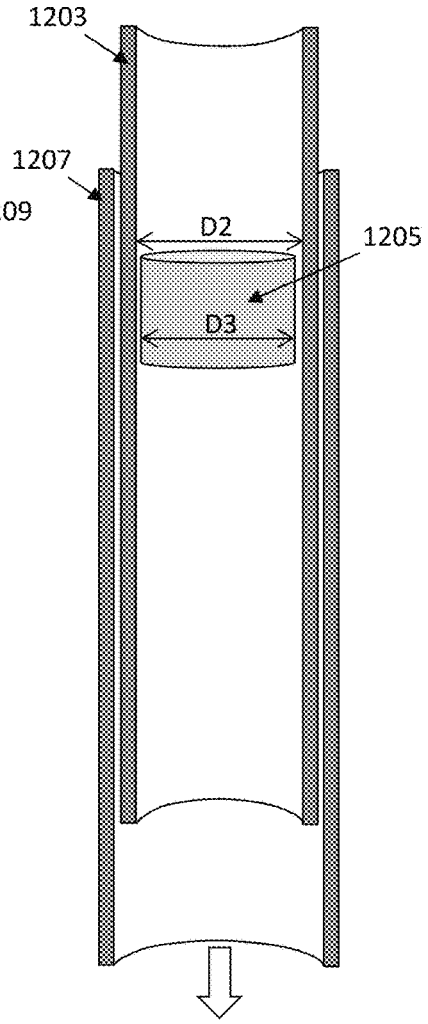

FIGS. 12A-12C illustrate another example of an actuator that may be used with a valve to form a thermally activated release device as described herein. In this example the actuator includes a first (e.g., inner) tube 1203 in which a plug 1205 of shape memory alloy is positioned, as in the previous example. A second (e.g., outer) tube 1207 is also included concentrically arranged over at least a portion of the axial length of the first tube. In FIG. 12A, the plug is shown in the unexpanded (diameter of $D_3$, where $D_3<D_2$), austenitic phase shape. The plug may then be expanded to lock the first and second tubes together (e.g., expanding to the dimeter of approximately $D_1$), as shown in FIG. 12B. As discussed above, the plug may be compressed while in the inner lumen of the first tube (arrows, FIG. 12B), for example. The expanded form of the plug in this example displaces the wall of the first and second tubes, as shown, preventing relative axial movement between the two tubes. In this example, both the first and second tubes are elastically deformable, so that when a change in temperature causes the plug to transition from the martensitic to the austenitic phase (e.g., returning to diameter $D_3$), as shown in FIG. 12C, the diameter of the first (and in this example, the second) tubes in the region of the tube holding the plug 1209 relax back to an un-stressed configuration having a narrower diameter (e.g., the inner tube returns from diameter $D_1$ to approximately $D_2$). This releases the lock between the first and second tubes, allowing axial movement of the second tube relative to the first tube, as shown in FIG. 12C. In some variations the device includes a valve (e.g., blocking a passageway for a fluid, such as a liquid (e.g., water, etc.) or gas (e.g., air, oxygen, etc.) that may be linked to the actuator so that the valve can open or close when the actuator releases, e.g., when the temperature of the plug exceeds the transition temperature. For example, a valve may be connected to the second tube and/or the plug and/or the first tube to translate the release in the lock between the plug, first tube and second tube into opening or closing of the valve.

Figure 13A:
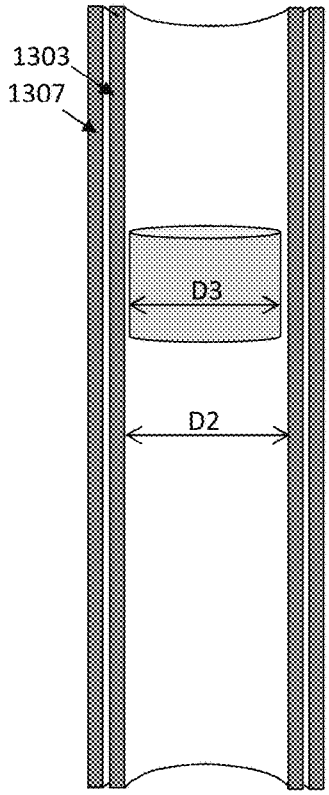
FIGS. 13A-13C illustrate another example of a telescoping thermally activated release device, similar to that shown in FIGS. 12A-12C, but with only the inner tube sufficiently elastic to contract when the shape memory alloy plug returns to the un-deformed diameter, as shown in FIG. 13C; the outer tube may plastically deform.
Figure 13B:
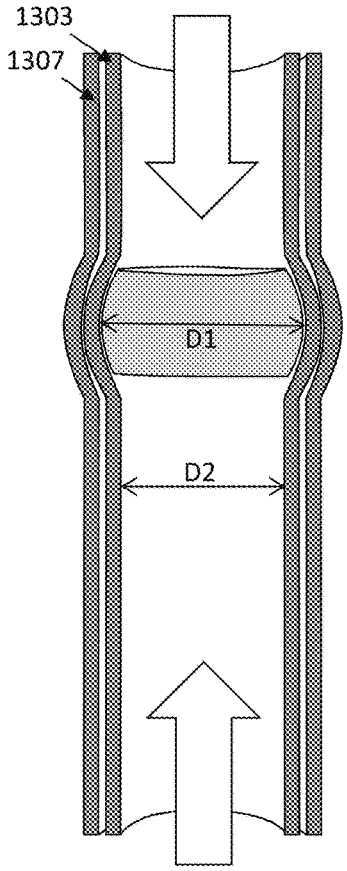
Figure 13C:
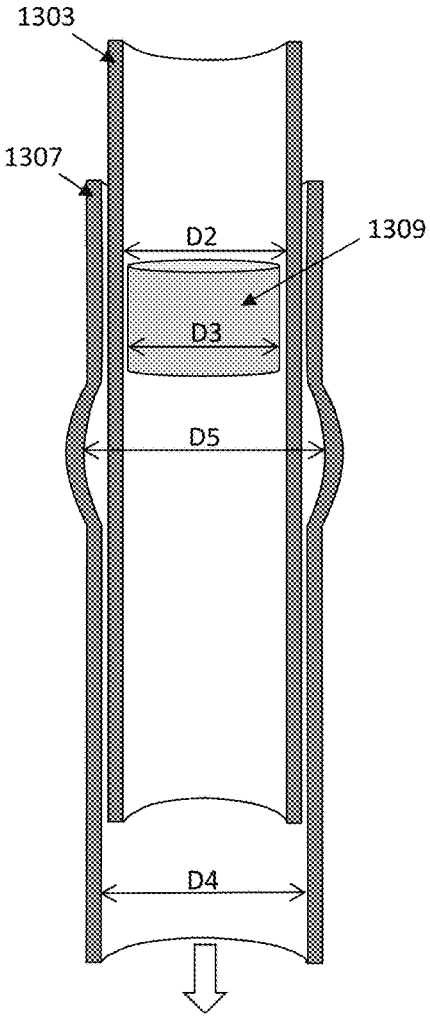

FIGS. 13A-13C illustrate another example of an actuator similar to that shown in FIG. 12A-12C, but with the second (e.g., outer) tube 1307 formed of a material that does not return to a narrower-diameter collapsed state when the temperature exceeds the transition temperature and converts to the narrower-diameter austenitic phase shape. The first (inner) tube 1303 is formed of a material that is elastically deformable over the range of deformation caused by the expansion of the plug 1309. The second (e.g., outer) tube remains deformed (e.g., having an inner diameter, $D_5$, that is greater than the un-deformed inner diameter of the tube (e.g., $D_4$, where $D_5>D_4$ and $D_4$ is greater than the outer diameter of the first, inner, tube 1303).

The variations shown in FIGS. 12A-12C and 13A-13C include telescoping tubes that are prevented from telescoping (axial movement) by the compression of the plug within the tube. In some configurations, the load force rests on the tubes, not on the shape memory alloy plug. Thus, variations in the load force do not affect (or significantly reduce the effect on) the plug; instead, the plug simply locks the two tubes together to prevent them from telescoping.

In this variation, the shape memory alloy plug may cause an interference fit in the coupling of two tubes, as shown in FIGS. 12B and in 13B. The compressed plug is expanded to cause an interference fit between two telescoping tubes. When the plug contracts (as the temperature shifts above the transition temperature to the austenitic phase) this interference is removed: the two tubes telescope together. In some variation one or both of the tubes may be a spring.

As mentioned above, the load force may therefore act on the tubes, not on the plug, so that stress does not modify the transition temperature of the plug. As described in FIGS. 12A-12C, two concentric tubes are configured to telescope together. When the plug is expanded, the telescoping movement is inhibited. Upon heating, the plug reduces in size, the two tubes become free to move.

Figure 14A:
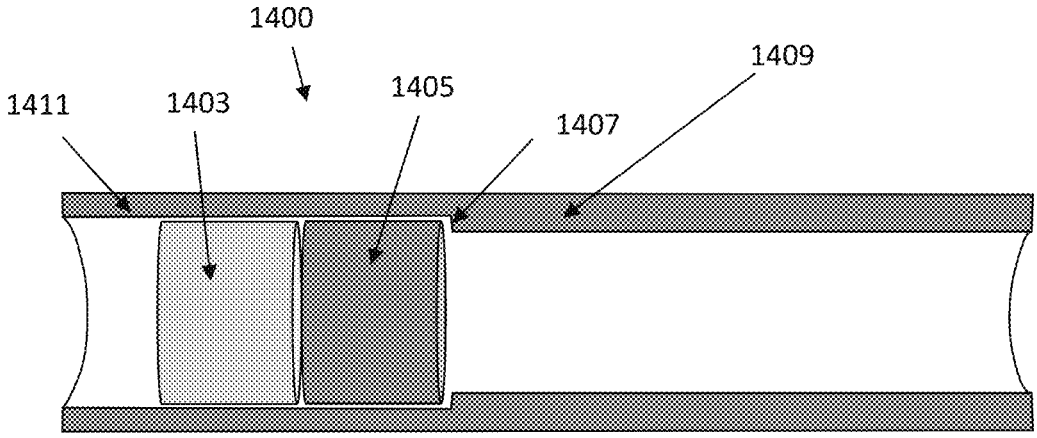
FIGS. 14A-14C illustrate an example of a thermally activated release device configured as a low-shock actuator, including two shape memory alloy plugs having different transition temperatures.
Figure 14B:
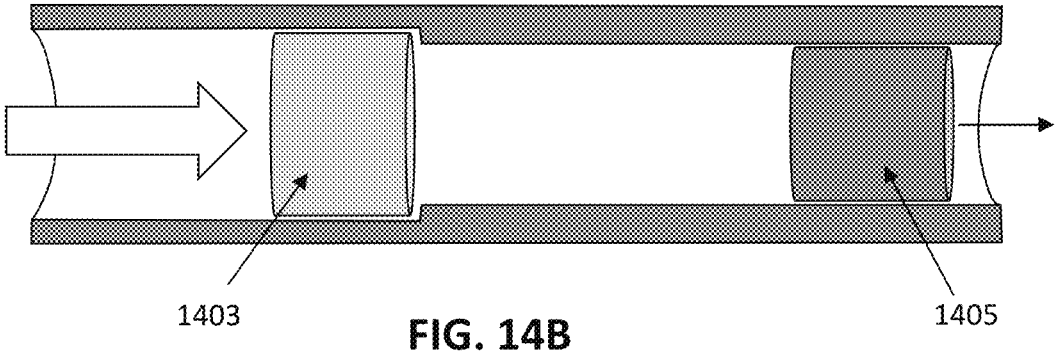
Figure 14C:
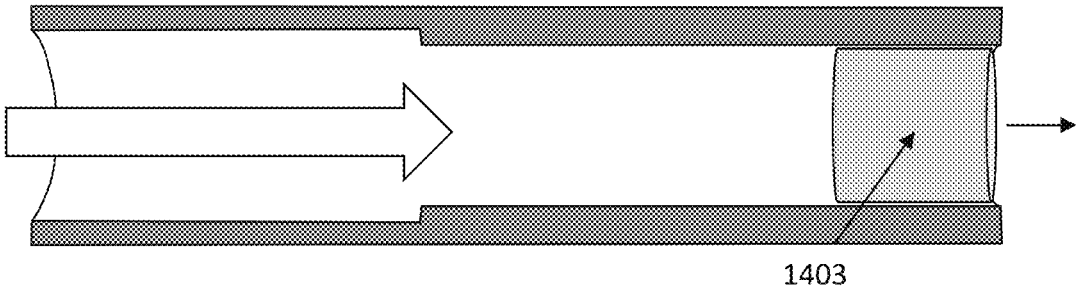

Any of the actuators described herein may also or alternatively be configured as a low-shock actuator. For example, FIGS. 14A-14C illustrate one example of a low-shock actuator 1400 having a pair of shape memory alloy plugs, each with a slightly different transition temperature between a larger-diameter martensitic shape and a narrower-diameter austenitic shape. In FIG. 14A, the actuator 1400 includes a tube having a first diameter region 1411 and a second diameter region 1409, as well as a first plug of shape memory alloy 1403 having a transition temperature that is slightly higher than that of the second plug of shape memory alloy 1405 that is located closer to the narrower-diameter region. When heated, the second plug is released, permitting the two plugs to move within the tube. Upon further heating the first plug transforms and allows both plugs to move within the tube. The actuator can be made a low-shock or essentially zero-shock actuator. This may have application in aerospace. To make a gradual release (leading to a shockless release) one may use two pieces (plug, cylinder) of shape memory alloy (e.g., CuAlNi), one with a slightly higher transition temperature. As the actuator is heated, the lower temperature component/plug transforms first, allowing motion through the cylinder until the higher-temperature component rests against a shoulder/ledge. Then as temperature rises further, the higher-temperature component transforms and releases, freeing the joint. This allows the load force to be released with greatly reduced shock.

Figure 15A:
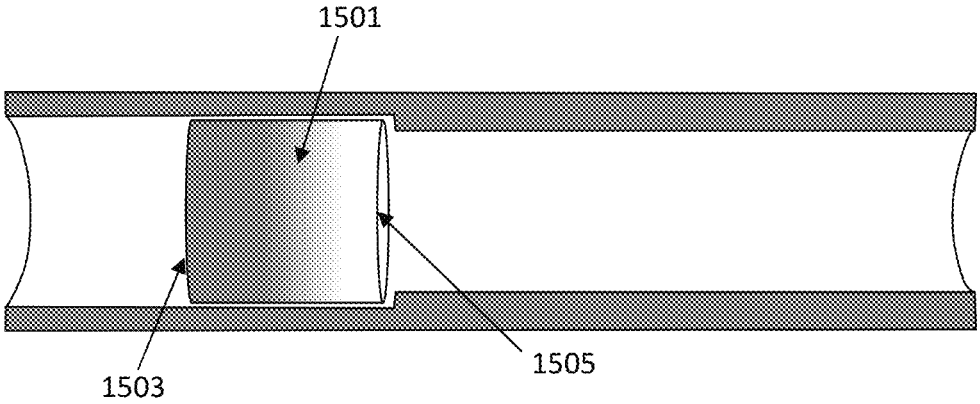
FIGS. 15A-15C show an example of a thermally activated release device configured as a low-shock actuator, including a shape memory alloy plug having regions of different transition temperatures.
Figure 15B:
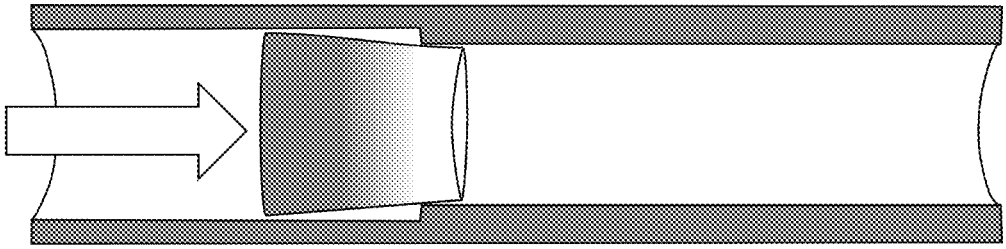
Figure 15C:
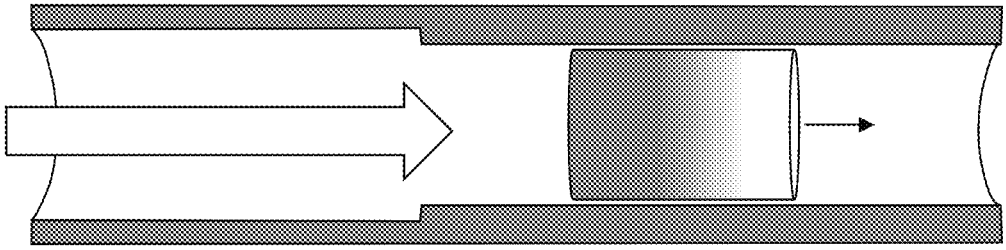

Alternatively, the two pieces may be one piece having different transition temperatures at the two ends, as illustrated in FIG. 15A-15C. In this example, the single shape memory alloy includes a proximal end 1503 (near the narrowing region of the tube) that transforms first, at a lower temperature than the distal end 1505, as shown in FIG. 15B. As the temperature increases beyond the transition temperature of the distal end, the entire plug will transform, as shown in FIG. 15C.

As used herein in the specification and claims, including as used in the examples and unless otherwise expressly specified, all numbers may be read as if prefaced by the word "about" or "approximately," even if the term does not expressly appear. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Also, any numerical range recited herein is intended to include all sub-ranges subsumed therein.

In general the thermally activated release devices described herein may use a solid 'pellet' shaped plug element. This plug element may be quite small, and even miniaturized. For example, the plug element may have a first configuration of diameter that is between about 0.1 mm and 100 mm. In contrast with prior art thermally activated release devices, including sprinkler valves, that use a SMA, only a very small amount of SMA material is needed.

As mentioned above, it may be advantageous to use a hyperelastic SMA, such as a single crystal SMA. Such as a single-crystal SMA may be compressed before insertion, and does not require any significant pre-processing (e.g., de-twinning etc.). In addition a hyperelastic SMA offers a greater displacement at a potentially lower setting force. Referring back to FIG. 10A, the stress plateau allows activation of the thermally activated release device in a small temperature range. The hyperelastic SMA plug element may simultaneously transform at or above the (settable) transition temperature. Simultaneous transformation of entire crystal may allow a quick response.

In general, the transition temperature of the plug elements described herein may be chosen and set. For example, the transition temperature can range from cryogenic to greater than 200° C. The transition temperature can be tuned to very narrow range by heat treatment. For example, the transition temperature of a CuAlNi single crystal maybe set by heat treatment as is known in the art. In contrast, the transition temperature of Nitinol is typically less than about 100° C. Further, the thermally activated release devices described herein may be configured for very sudden, rapid release. For example, the release can be sudden, at predetermined temperature.

As mentioned above, a thermally activated release device may be used as part of any device or system in which it is desired to have a reliable and rapid thermally controlled release of an element. Fluid valve examples are provided above, however these thermally activated release devices are not limited to this utility. Other examples may include non-explosive separation devices, which may be particularly useful in space or deep water applications. Any of the variations described herein may be made very small, which allows the actuation to be nearly instantaneous, as a small plug element may heat rapidly, and transform virtually instantaneously.

While various (including preferred) embodiments of the present invention have been shown and described herein, such embodiments are provided by way of example only. Numerous variations, changes, and substitutions will occur to those skilled in the art based on this description without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A thermally activated release device, the device comprising:

an actuator comprising:

a tube having a first region of inner diameter $D_1$ in fluid communication with a second region of inner diameter $D_2$, wherein the second region of inner diameter $D_2$ is less than the first region of inner diameter $D_1$; and a plug of shape memory alloy within the tube, wherein the plug of shape memory alloy comprises a martensitic phase shape having an outer diameter that is between the first region of inner diameter $D_1$ and the second region of inner diameter $D_2$ and an austenitic phase shape having an outer diameter that is less than or equal to the second region of inner diameter $D_2$;

wherein the actuator is configured so that a temperature change causes the plug of shape memory alloy to change from the martensitic phase shape to the austenitic phase shape so that the plug of shape memory alloy moves from the first region of inner diameter $D_1$ to the second region of inner diameter $D_2$ within the tube; and a valve coupled to the actuator, wherein the valve opens when the plug of shape memory alloy moves from the first region to the second region within the tube.

2. The device of claim 1, wherein the first region comprises an expanded region of the tube.

3. The device of claim 1, wherein a circumferential side wall of the plug of shape memory alloy fits against an inner wall of the first region.

4. The device of claim 1, wherein the tube is open at a top and a bottom.

5. The device of claim 1, wherein the tube comprises a first tube that is elastically deformable so that when the plug of shape memory alloy within the first tube changes to the austenitic phase shape of the first region of inner diameter $D_1$ contracts to a diameter that is between the inner diameter $D_1$ and the inner diameter $D_2$.

6. The device of claim 5, further comprising an outer tube circumferentially fitting over at least the first region of inner diameter $D_1$ of the first tube, wherein the outer tube is locked against the first tube when the plug of shape memory alloy within the first tube is in the martensitic phase shape.

7. The device of claim 6, wherein the outer tube is configured to move telescopically over the first tube after the plug of shape memory alloy within the first tube changes to the austenitic phase shape.

8. The device of claim 1, further comprising a valve poppet mechanically coupled to the plug, wherein the valve poppet is configured to release when the plug changes to the austenitic phase.

9. The device of claim 1, further comprising a pin connected to the plug and configured to be displaced when the plug moves from the first region to the second region.

10. The device of claim 1, wherein the thermally activated release device is configured as part of a fire sprinkler valve also comprising a valve body configured to connect to a pressurized fluid source that is restrained when the plug is in the martensitic phase shape and released when the plug of shape memory alloy is in the austenitic phase shape.

11. The device of claim 1, further comprising a bias urging the plug towards the second region.

12. The device of claim 1, wherein the plug of shape memory alloy comprises a first plug of shape memory alloy, and further comprising a second plug of shape memory alloy adjacent to the first plug of shape memory alloy, further wherein the second plug of shape memory alloy comprises a martensitic phase shape having an outer diameter that is between the first region of inner diameter $D_1$ and the second region of inner diameter $D_2$ and an austenitic phase shape having an outer diameter that is less than or equal to $D_2$, further wherein a transition temperature between the martensitic and the austenitic phase shape for the second plug of shape memory alloy is different than a transition temperature between the martensitic and austenitic phase shape for the first plug of shape memory alloy.

13. The device of claim 1, wherein the plug of shape memory alloy comprises a first region comprising a first transition temperature for transitioning between the martensitic and the austenitic phase shape and a second region having a second phase transition temperature for transitioning between the martensitic and the austenitic phase shape, further wherein the first region is on an opposite end of the plug of shape memory alloy relative to the second region.

14. The device of claim 1, wherein the plug of shape memory alloy comprises a cylindrical plug.

15. The device of claim 1, wherein the plug of shape memory alloy comprises a single crystal shape memory alloy.

16. The device of claim 15, wherein the plug of shape memory alloy comprises a CuAlNi alloy.

17. The device of claim 1, further comprising:

a fluid passageway configured to connect to a source of pressurized fluid, wherein the fluid passageway is coupled to the valve so that when the temperature exceeds a transition temperature between the martensitic and austenitic phase shape for the plug of shape memory alloy, the plug moves from the first region to the second region within the tube and opens the fluid passageway.

* * * * *